US006419539B1

(12) United States Patent
Tamura et al.

(10) Patent No.: US 6,419,539 B1
(45) Date of Patent: Jul. 16, 2002

(54) METHOD OF MANUFACTURING ELECTRON-EMITTING DEVICE, ELECTRON SOURCE AND IMAGE-FORMING APPARATUS, AND APPARATUS OF MANUFACTURING ELECTRON SOURCE

(75) Inventors: Miki Tamura, Isehara; Toshikazu Ohnishi, Sagamihara; Kazuhiro Jindai, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,641

(22) Filed: Feb. 24, 2000

(30) Foreign Application Priority Data

Feb. 25, 1999 (JP) ..... 11-047803
Feb. 24, 2000 (JP) ..... 2000-047625

(51) Int. Cl.[7] ..... H01J 9/02; H01J 1/304
(52) U.S. Cl. ..... 445/6; 445/60
(58) Field of Search ..... 445/6, 60, 73

(56) References Cited

U.S. PATENT DOCUMENTS 5,066,883 A * 11/1991 Yoshioka ..... 313/309
5,853,310 A * 12/1998 Nishimura et al. ..... 445/24

FOREIGN PATENT DOCUMENTS

| | | |
|---|---|---|
| EP | 0 660 357 | 6/1995 |
| EP | 0 692 809 | 1/1996 |
| EP | 0 800 198 | 10/1997 |
| EP | 0 908 916 | 4/1999 |
| EP | 0 955 662 | 11/1999 |
| EP | 1 032 012 | 8/2000 |
| JP | 1-031332 | * 2/1989 |
| JP | 1-283749 | * 11/1989 |
| JP | 2-257552 | * 10/1990 |
| JP | 7-235255 | 9/1995 |
| JP | 8-7749 | 1/1996 |
| JP | 10-50206 | 2/1998 |

OTHER PUBLICATIONS

W.P. Dyke, et al., "Field Emission", Advances in Electronics and Electron Physics, vol. VIII, pp. 89–185 (1956).
M.I. Elinson, et al., "The Emission of Hot Electrons and the Field Emission of Electrons from Tin Oxide", Radio Engineering and Electronic Physics, No. 7, pp. 1290–1296 (Jul. 1965).
C.A. Mead, "Operation of Tunnel–Emission Devices", Journal of Applied Physics, vol. 32, No. 4, pp. 646–652 (Apr. 1961).
M. Hartwell, et al., "Strong Electron Emission from Patterned Tin–Indium Oxide Thin Films", International Electron Devices Meeting, pp. 519–521 (1975).
H. Araki, et al., "Electroforming and Electron Emission of Carbon Thin Films", Journal of the Vacuum Society of Japan, vol. 26, No. 1, pp. 22–29 (Jan. 26, 1983).
G. Dittmer, "Electrical Conduction and Electron Emission of Discontinuous Thin Films", Thin Solid Films, No. 9, pp. 317–329 (1972).
C.A. Spindt, et al., "Physical Properties of Thin–Film Field Emission Cathodes with Molybdenum Cones", Journal of Applied Physics, vol. 47, No. 12, pp. 5248–5263 (Dec. 1976).

* cited by examiner

*Primary Examiner*—Kenneth J. Ramsey
(74) *Attorney, Agent, or Firm*—Fitzpatrick, Cella, Harper & Scinto

(57) ABSTRACT

A method of manufacturing an electron-emitting device includes a process for forming a pair of electric conductors spaced from each other on a substrate, and an activation process for forming a film of carbon or a carbon compound on at least one of the pair of electric conductors. The activation process is sequentially performed within plural containers having different atmospheres.

14 Claims, 14 Drawing Sheets

ACTIVATION APPARATUS
(SCHEMATIC)

METHOD OF MANUFACTURING ELECTRON-EMITTING DEVICE, ELECTRON SOURCE AND IMAGE-FORMING APPARATUS, AND APPARATUS OF MANUFACTURING ELECTRON SOURCE

BACKGROUND OF THE INVENTION

1. Field of the Invention

The present invention relates to a method of manufacturing an electron-emitting device, an electron source and an image-forming apparatus, and an apparatus of manufacturing the electron source.

2. Related Background Art

Two kinds of electron-emitting devices: a thermoelectron source and a cold cathode electron source are conventionally known. The types of the cold cathode electron-source include a field emission type (hereinafter abbreviated as an FE type) electron-emitting device, a metal/insulating layer/metal type (hereinafter abbreviated as a MIM type) electron-emitting device, and a surface conduction electron-emitting device.

Known examples of the FE type are described by W. P. Dyke & W. W. Dolan in "Field emission" Advance in Electron Physics, 8, 89 (1956), by C. A. Spindt in "Physical Properties of thin-film field emission cathodes with molybdenum cones," J. Appl. Phys., 47, 5248 (1976), etc.

In contrast to this, known examples of the MIM type are described by C. A. Mead in "Operation of Tunnel-Emission Devices," J. Apply. Phys. 32, 646 (1961) etc.

Examples of the surface conduction electron-emitting device are described by M. I. Elinson, Radio Eng. Electron Phys., 10, 1290, (1965), etc.

The surface conduction electron-emitting device utilizes a phenomenon in which electrons are emitted by flowing an electric current through a thin film of a small area formed on a substrate in parallel with a film face. Examples of this surface conduction electron-emitting device using an $SnO_2$ thin film made by Elinson, etc. mentioned above, an Au thin film (G. Ditmmer, Thin Solid Films, 9, 317 (1972)), an $In_2O_3/SnO_2$ thin film (M. Hartwell and C. G. Fonsted, IEEE Trans. ED Conf., 519 (1975)), a carbon thin film (Hisashi ARAKI, et al.: SHINKU (Vacuum), Vol. 26, No. 1, p. 22 (1983)), and the like have been reported.

The present applicant has made many proposals with respect to the surface conduction electron-emitting device having a novel construction and its application. For example, a basic construction and a manufacturing method of the surface conduction electron-emitting device, etc. are disclosed in Japanese Patent Application Laid-Open Nos. 7-235255 and 8-7749, etc. Main features of the above disclosure will next be explained briefly.

As schematically shown in FIG. 15A (a plan view) and FIG. 15B (a cross-sectional view), this surface conduction electron-emitting device is constructed by a pair of device electrodes 2, 3 opposed to each other on a substrate 1, and an electroconductive film 4 having a clearance 5*a* in one portion thereof and connected to the device electrodes. The clearance 5*a* is formed by a deposition film 6 deposited on the electroconductive film 4 and having carbon or a carbon compound as a main component. This electron-emitting device can emit electrons from a portion near the clearance 5*a* by applying a voltage between the device electrodes 2 and 3.

A conventional manufacturing method of the electron-emitting device will next be explained by using FIGS. 16A to 16D.

An electrode material is vacuum evaporated or sputtered to form a film on the substrate 1, and is patterned in a desirable shape by using a photolithography technique so that device electrodes 2, 3 are formed. An electroconductive film 4 is formed on the device electrodes 2, 3. Methods of vacuum evaporation, sputtering, CVD (chemical vapor deposition method), coating, etc. can be used in the formation of the electroconductive film 4.

Next, a voltage is applied between the device electrodes 2 and 3, and an electric current flows through the electroconductive film 4 so that a clearance 5 such as a crack, etc. is formed in one portion of the electroconductive film 4. This process is called a forming process.

An activation process is next performed. The activation process is a process for depositing carbon and/or a carbon compound 6 in the clearance 5 formed by the forming process. An emission current can be greatly increased by this activation process.

The activation process is conventionally performed by arranging an electron-emitting device within a vacuum container and highly evacuating the vacuum container and then applying a pulse voltage to the electron-emitting device after a lean organic substance gas is introduced. Thus, the organic substance existing at a low partial pressure in the vacuum is decomposed and polymerized and is deposited in the vicinity of the clearance 5 as carbon and/or a carbon compound.

Next, a stabilization process is preferably performed. This stabilization process is a process for sufficiently removing molecules of the organic substance adsorbed to the electron-emitting device itself and its peripheral portion, or a wall face of the vacuum container for operating the electron-emitting device so that carbon and/or the carbon compound may not be further deposited even when the electron-emitting device is operated after this removal, thereby stabilizing characteristics of the electron-emitting device.

Such an electron-emitting device is simple in construction and is easily manufactured so that many electron-emitting devices can be arranged and formed in a large area. Therefore, an electron source of a large area can be formed by forming plural electron-emitting devices on the substrate and electrically connecting the electron-emitting devices to each other by wiring. An image-forming apparatus can be also formed by combining the above electron source and an image-forming member with each other.

A construction shown in FIG. 17 is widely known as the FE type electron-emitting device.

In FIG. 17, reference numerals 101, 102 and 103 respectively designate a substrate, a cathode electrode and an emitter. Reference numerals 105 and 104 respectively designate a gate electrode for emitting electrons from the emitter, and an insulating layer for electrically insulating the cathode electrode 102 and the gate electrode 105 from each other. There is also a case in which an electric current limiting resistance layer 106 is formed between the cathode electrode 102 and the emitter 103.

In the above FE type electron-emitting device, electrons are emitted from a tip of the emitter 103 when a voltage from several ten V to about several hundred V is applied between the cathode electrode 102 and the gate electrode 105. At this time, when an anode substrate is arranged above the electron-emitting device and an anode voltage of several kV is applied, the emitted electrons are trapped by the anode substrate.

The FE type electron-emitting device is variously considered to reduce the driving voltage and increase electron emitting efficiency. For example, the distance between the gate electrode and the emitter is reduced; a radius of curvature of the emitter is reduced; an emitter surface is covered with a low work function material, etc. Further, a technique for depositing a carbon compound on the emitter surface and improving the electron emitting efficiency by applying the voltage between the cathode electrode and the anode electrode in an atmosphere containing the organic substance is disclosed in recent years (Japanese Patent Application Laid-Open No. 10-50206).

In such an FE type electron-emitting device, the image-forming apparatus can be also formed by forming plural electron-emitting devices on the substrate and forming an electron source and combining the electron source with an image-forming member.

In the above activation process for depositing carbon or the carbon compound in conventional manufacturing methods of the electron-emitting device and the electron source, the organic substance existing at a low partial pressure in the vacuum is decomposed and polymerized and is deposited as carbon and/or the carbon compound. Therefore, it takes too much time to perform the activation process. Otherwise, more processing time is required to activate the electron source particularly having plural electron-emitting devices while a consuming speed of the organic substance consumed by the activation is increased with respect to a supply speed of the organic substance used in the activation. Accordingly, there is a case in which lack of the organic substance during the activation process causes no sufficient activation.

In particular, it is required in recent years that the image-forming apparatus to which the electron-emitting device is applied is large-sized. A large-sized image-forming apparatus will bring serious problems.

When the partial pressure of the organic substance used in the activation is increased, the above problem of the insufficiency of the supply of the organic substance is solved. However, when the activation is performed in the atmosphere having a high partial pressure of the organic substance, a problem exists in that no preferable electron-emitting characteristics are easily obtained.

SUMMARY OF THE INVENTION

An object of the present invention is to provide a method of manufacturing an electron-emitting device and an electron source capable of greatly shortening a time required for an activation process while preferable electron-emitting characteristics are obtained in the activation process in the method of manufacturing the electron-emitting device and the electron source.

Another object of the present invention is to provide a method and an apparatus of manufacturing the electron source in which the insufficiency of an organic substance during the activation process is solved to perform sufficient activation, and further to provide a method of manufacturing an image-forming apparatus using this electron source.

The present invention resides in a method of manufacturing an electron-emitting device, characterized by comprising a process for forming a pair of electric conductors spaced from each other on a substrate, and an activation process for forming a film of carbon or a carbon compound on at least one of the pair of electric conductors, wherein the activation process is sequentially performed within plural containers having different atmospheres.

Further, the present invention resides in a method of manufacturing an electron-emitting device, characterized by comprising a process for forming an electroconductive film on a substrate, including an electron-emitting region arranged between a pair of electrodes, and an activation process for forming a film of carbon or a carbon compound on the electroconductive film, wherein the activation process is sequentially performed within plural containers having different atmospheres.

Sill further, the present invention resides in a method of manufacturing an electron source, characterized by comprising a process for forming plural pairs of electric conductors each spaced from each other on a substrate, and an activation process for forming a film of carbon or a carbon compound on at lease one of each of the pairs of electric conductors, wherein the activation process is sequentially performed within plural containers having different atmospheres.

Still further, the present invention resides in a method of manufacturing an electron source, characterized by comprising a process for forming plural electroconductive films on a substrate, including an electron-emitting region arranged between a pair of electrodes, and an activation process for forming a film of carbon or a carbon compound on each of the electroconductive films, wherein the activation process is sequentially performed within plural containers having different atmospheres.

Still further, the present invention resides in an apparatus of manufacturing an electron source, comprising plural containers, means for exhausting each of the plural containers and means for introducing a gas into each of the containers, the exhausting and introducing means being arranged in each of the plural containers, and means for carrying a substrate on which the electron source is formed to/from each of the containers.

Still further, the present invention resides in a method of manufacturing an image-forming apparatus having an electron source and an image-forming member for forming an image by irradiating electrons from the electron source, wherein the electron source is manufactured by any one of the above manufacturing methods.

DESCRIPTION OF THE PREFERRED EMBODIMENTS

Figure 1A:
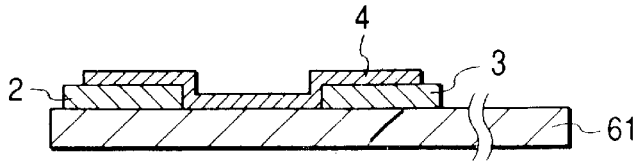
FIGS. 1A, 1B, 1C and 1D are cross-sectional views showing a method of manufacturing an electron source in accordance with the present invention.

The present inventors have considered that a method for performing activation at many stages in different atmospheres is effective to solve the above-mentioned problems in the conventional activation process and to manufacture an electron-emitting device and an electron source having preferable electron-emitting characteristics.

Such a method may be exemplified by, for example, an activation method of performing activation at many stages by dividing a process for supplying an organic substance required in the activation to an electron-emitting region or a process for depositing carbon and/or a carbon compound required in an activating progress on to the electron-emitting region, and a process for forming the electron-emitting region having preferable electron emitting characteristics.

However, in this case, when the activation is performed in different atmospheres within the same container, processes must be repeated in which the organic substance is introduced and the activation is performed and the introduced organic substance is sufficiently exhausted, the organic substance is introduced, the activation is performed and so on. Accordingly, for example, when the organic substance having a long average staying time is used, the organic substance is left within the vacuum container after being exhausted. Therefore, there is a case in which the left organic substance has an influence on the next activation process.

Further, a process for baking the vacuum container, etc. is required to remove the leftover organic substance. Accordingly, there is a case in which the process becomes complicated.

In order to solve the above-mentioned problems, present invention provides a method of manufacturing an electron-emitting device and an electron source.

The present invention resides in a method of manufacturing an electron-emitting device characterized by comprising a process for forming a pair of electric conductors spaced from each other on a substrate, and an activation process for forming a film of carbon or a carbon compound on at least one of the pair of electric conductors, wherein the activation process is sequentially performed within plural containers having different atmospheres.

Further, the present invention resides in a method of manufacturing an electron-emitting device characterized by comprising a process for forming an electroconductive film on a substrate, including an electron-emitting region arranged between a pair of electrodes, and an activation process for forming a film of carbon or a carbon compound on the electroconductive film, wherein the activation process is sequentially performed within plural containers having different atmospheres.

Still further, the present invention resides in a manufacturing method of an electron source characterized by comprising a process for forming plural pairs of electric conductors each spaced from each other on a substrate, and an activation process for forming a film of carbon or a carbon compound on at least one of each of the pairs of electric conductors, wherein the activation process is sequentially performed within plural containers having different atmospheres.

Still further, the present invention resides in a method of manufacturing an electron source, characterized by comprising a process for forming plural electroconductive films on a substrate, including an electron-emitting region arranged between a pair of electrodes, and an activation process for forming a film of carbon or a carbon compound on each of the electroconductive films, wherein the activation process is sequentially performed within plural containers having different atmospheres.

Furthermore, the above manufacturing method according to the present invention also includes that:

- the plural containers include plural containers in which kinds of gases contained in the atmospheres are different from each other, and at least two of the containers include the carbon compound in the atmospheres;
- the plural containers include plural containers in which carbon compounds contained in the atmospheres are different from each other;
- the plural vacuum containers include plural vacuum containers in which partial pressures of the carbon compound contained in the atmospheres are different from each other;
- the activation process includes a process for applying a voltage between the pair of electric conductors in an atmosphere containing the carbon compound; and
- the activation process includes a process for applying a voltage between the pair of electrodes in an atmosphere containing the carbon compound.

Further, the present invention resides in an apparatus of manufacturing an electron source characterized by comprising plural containers, means for exhausting each of the plural containers and means for introducing a gas into each of the containers, the exhausting and introducing means being arranged in each of the plural containers, and means for carrying a substrate on which the electron source is formed to/from each of the containers.

The above manufacturing apparatus of the present invention also includes that:

- the manufacturing apparatus further comprises means for controlling a temperature of the substrate within each of the containers;
- the gas is a gas of a carbon compound;
- each of the containers is a container accommodating the substrate therein; and
- each of the containers is a container covering one portion region of the substrate side on which the electron source is formed.

Moreover, the present invention resides in a method of manufacturing an image-forming apparatus having an electron source and an image-forming member for forming an image by irradiating electrons from the electron source, wherein the electron source is manufactured by any one of the above manufacturing methods.

In accordance with the method of manufacturing the electron-emitting device and the electron source of the present invention, the activation process is performed at many stages by using the plural containers in different atmospheres. As a result, the processing time required in the conventional activation process is greatly shortened and the problem of insufficiency of the supply of an activating substance is solved while the electron source having preferable electron-emitting characteristics can be manufactured. Further, the activation can be performed with good reproducibility since the influence of a substance left within the containers can be avoided. Therefore, dispersion in manufacture can be reduced and yield can be improved.

Further, a high grade image-forming apparatus, e.g., a flat color television can be provided by applying the electron source manufactured by the method of manufacturing the electron source in accordance with the present invention.

Further, in accordance with the apparatus of manufacturing the electron source of the present invention, each container has means for exhausting the container and means for introducing a gas into the container. Accordingly, the atmosphere within each container can be independently set and controlled. Furthermore, since each container further has means for carrying the substrate on which the electron source is formed to/from each container, the substrate can be sequentially efficiently conveyed into the above atmosphere individually controlled so that productivity is efficiently improved.

The electron-emitting device according to the present invention has a pair of electric conductors spaced from each other on the substrate and serves to emit electrons by applying a voltage between the pair of electric conductors. For example, this electron-emitting device includes the above-mentioned surface conduction electron-emitting device and the field emission type electron-emitting device called the FE type electron-emitting device.

Here, in the case of the FE type electron-emitting device, the above pair of electric conductors correspond to an emitter and a gate electrode described below in detail, and carbon or the carbon compound is deposited onto the emitter.

In the case of the surface conduction electron-emitting device, the above pair of electric conductors correspond to a pair of electroconductive films described below in detail, and carbon or the carbon compound is deposited onto one or both of the pair of electroconductive films.

Hereinafter, a description will be made of a preferred embodiment of the present invention.

As indicated in FIGS. 1A to 1D, the present invention relates to a manufacturing method of an electron source. However, before describing the manufacturing method, a description will be made of an electron-emitting device according to the present invention and an electron source composed of a plurality of such electron-emitting devices with reference to FIGS. 2 and 6.

Figure 2:
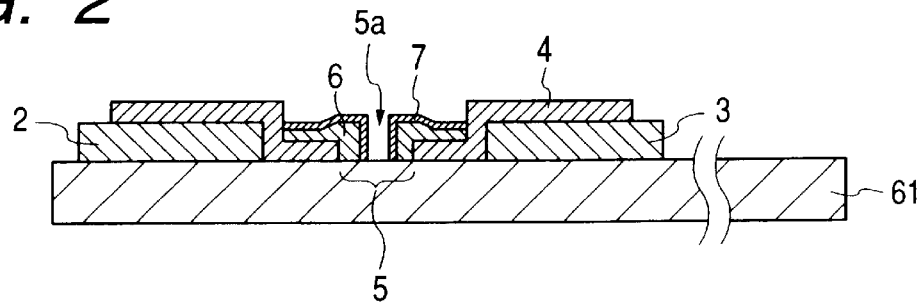
FIG. 2 is a cross-sectional view of an electron-emitting device in accordance with the present invention.
Figure 6:
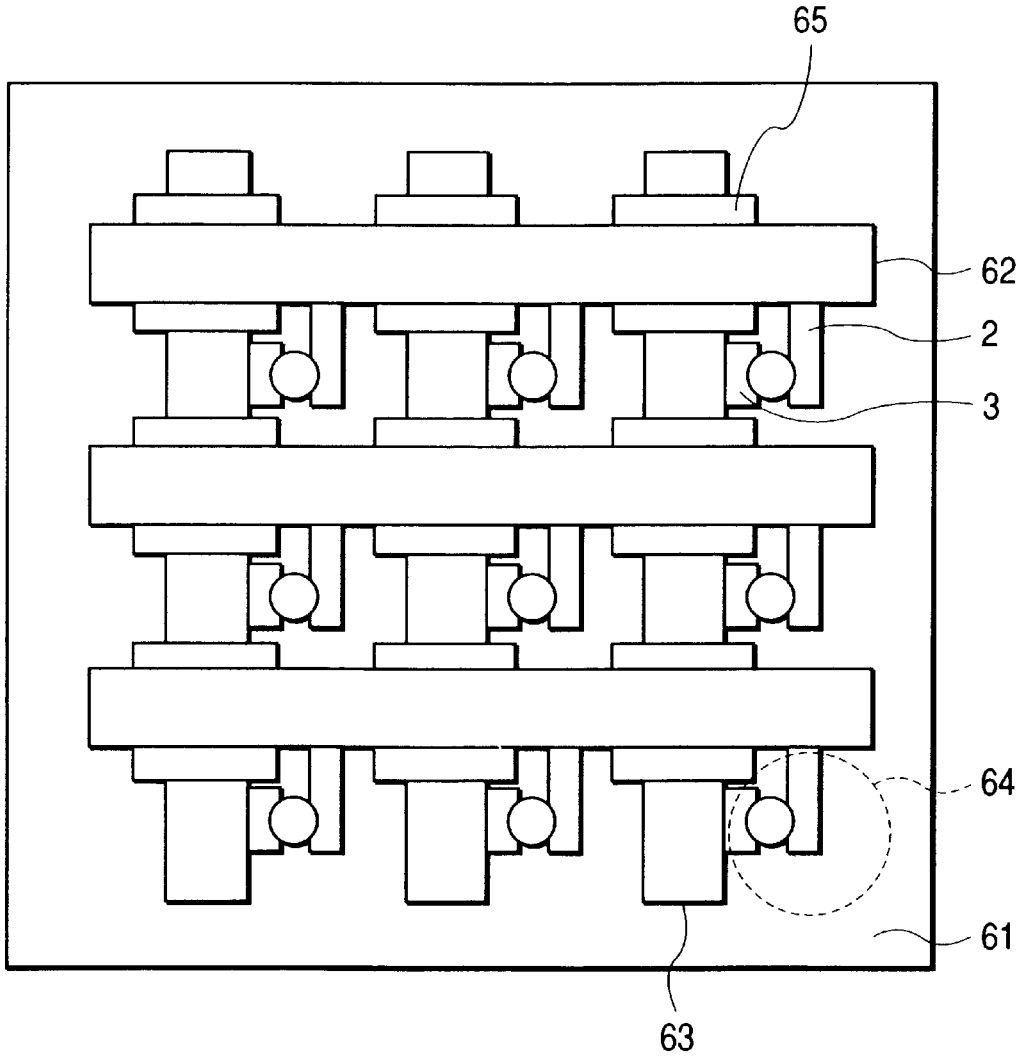
FIG. 6 is a plan view showing one example of the electron source arranged in a simple matrix to which the present invention can be applied.

FIG. 2, first, shows a structural example of a surface conduction electron-emitting device comprising a substrate 61, device electrodes 2 and 3, electroconductive films 4 that are connected to the device electrodes 2 and 3 respectively, a first gap 5 formed in the electroconductive films 4, carbon films 6 and 7 mainly composed of carbon or carbon compounds and allocated in the electroconductive films 4 and in the first gap 5, and a second gap 5*a* formed by carbon films 6 and 7 which is narrower than the first gap 5. The electron-emitting device formed of the above-mentioned components as shown in FIG. 2 is a device that emits electrons from the vicinity of the above-mentioned second gap 5*a* when voltage is applied to the device electrodes 2 and 3. FIG. 6 is a structural diagram showing a part of an electron source having a plurality of surface conduction electron-emitting devices shown in FIG. 2, in which reference numeral 61 denotes an X-directional wiring 62; 63, a Y-directional wiring; 64, a surface conduction electron-emitting device; 65, an insulating layer for insulating the X-directional wiring 62 and the Y-directional wiring 63. A plurality of the electron-emitting devices 64 are wired in matrix by the plurality of X-directional wirings 62 and the plurality of Y-directional wirings 63.

The manufacturing method of the present invention is applicable to the above-mentioned electron-emitting device or to a method for manufacturing the electron source having a plurality of the electron-emitting devices. Referring to FIGS. 1A to 1D, the manufacturing method for the electron source of the present invention will be explained. It should be noted that only a single electron-emitting device is described in FIGS. 1A to 1D for the sake of conveniences. FIGS. 1A to 1D show the substrate 61, device electrodes 2 and 3, the electrodconductive film 4, the above-mentioned first gap 5, film depositions of carbon or carbon compounds 6 and 7, the above-mentioned second gap 5*a*, a first vacuum container 11, a second vacuum container 12, a gas introduction valve 13, an exhaust gas valve 14, an exhaust device 15 composed of a vacuum pump and the like, and carbon compounds 16 and 17 such as organic substances used for the activation.

First, as shown in FIG. 1A, the device electrodes 2 and 3 are formed on the substrate 61. The electrodes 2 and 3 can be formed by combining a printing method or a film formation method such as vacuum evaporation and sputtering, with the photolithography technology.

Next, the X-directional wiring 62, the Y-directional wiring 63, and the insulating layer 64 are formed. The X-directional wiring 62, the Y-directional wiring 63, and the insulating layer 64 can be formed by combining the printing method or the film formation method such as vacuum evaporation and sputtering with the photolithography technology.

The electroconductive film 4 is then formed. Vacuum evaporation, sputtering, and other methods can be used to deposit the material of the electroconductive film 4. Other methods such as patterning and applying a solution having the raw materials of the electroconductive film 4 can also be used. For example, an applicable method is applying a metal organic compound solution and decomposing it thermally to obtain metal or metal oxide. If the process is performed under an applicable condition, a fine particle film can be formed. At this time, after forming the electroconductive film 4, patterning may be made to obtain a desired shape. However, if the above-mentioned material solution is applied thereon to obtain a desired shape by using an ink jet apparatus etc., and then thermal decomposition is carried out therefor, a desired shape of the electroconductive film 4 can be obtained without the patterning process.

Figure 1B:
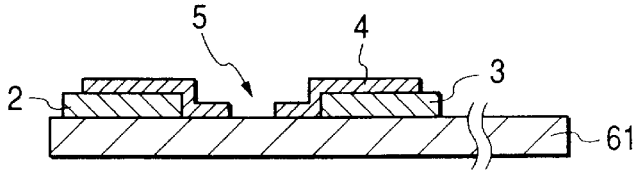
Figure 4A:
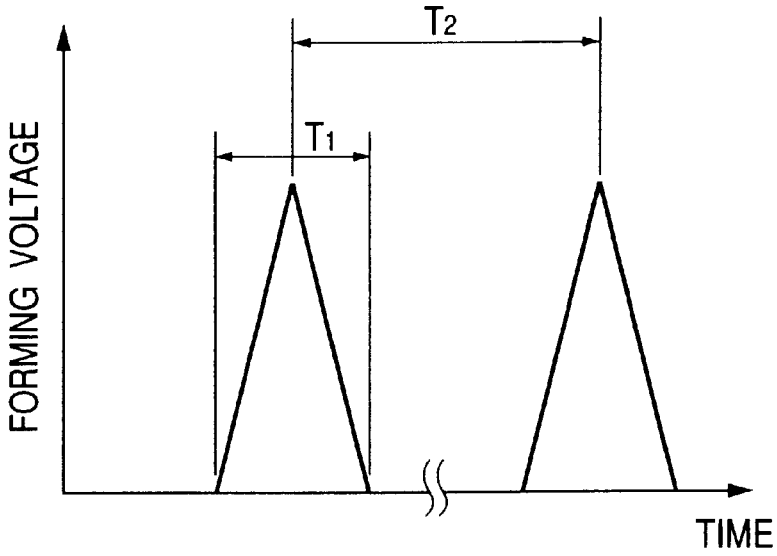
FIGS. 4A and 4B are graphs showing one example of the voltage waveform suitable for the method of manufacturing the electron source in accordance with the present invention.
Figure 4B:
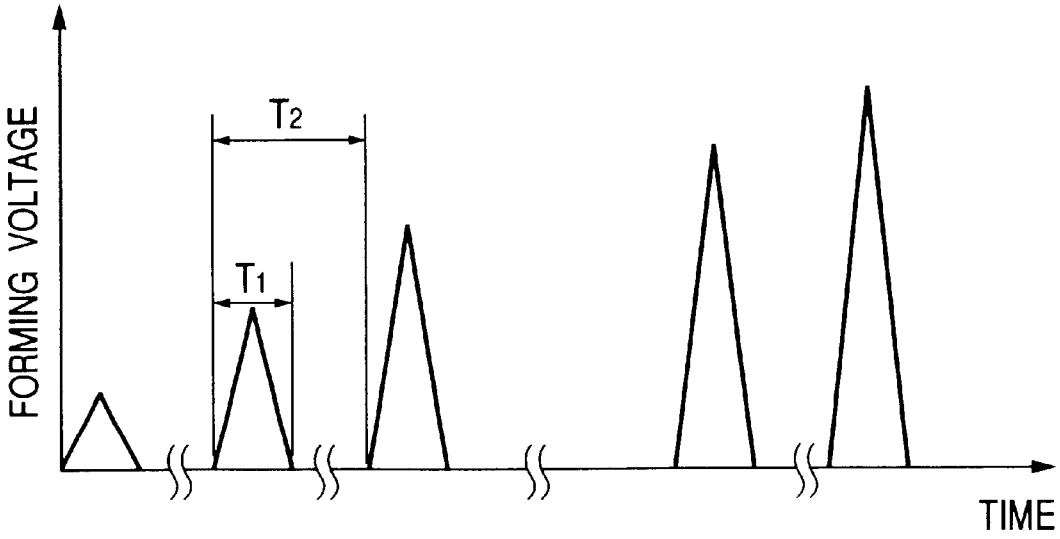

Next, as shown in FIG. 1B, the first gap 5 is formed. A method can be applied to this formation, in which a voltage is applied to the device electrodes 2 and 3 via the X-directional wiring 62 and the Y-directional wiring 63, and an electric current is allowed to flow the electroconductive film 4 to thereby form cracks in a portion of the electroconductive film 4 (what is known as the energization forming process). During this process, a pulse voltage is preferable as the voltage to be applied. The pulse voltage as shown in FIG. 4A is a waveform with a fixed wave height and the one shown in FIG. 4B is a waveform with a gradual increase of wave height along with time. Either or a combination of the two forms of pulse voltage can be applied.

Additionally, during the pulse suspension period (between pulses) for forming, a resistance value is measured by inserting a pulse with sufficiently low wave-height value. When the resistance value has been sufficiently increased due to the formation of an electron-emitting portion (for instance, if the resistance value exceeds 1 MQ), an application of the pulse may be ended.

It is preferable that the above-mentioned process be performed in a vacuum or in an atmosphere containing a reducible gas such as hydrogen.

Figure 1C:
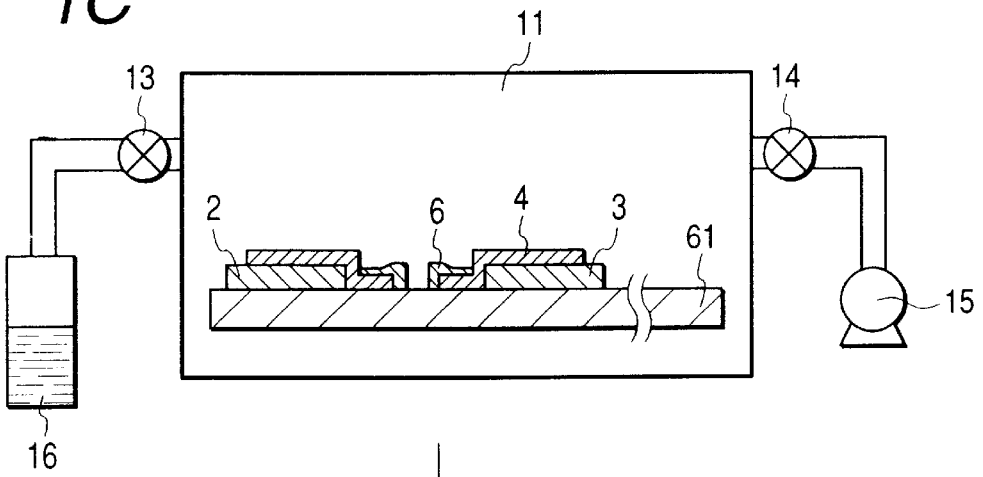
Figure 3:
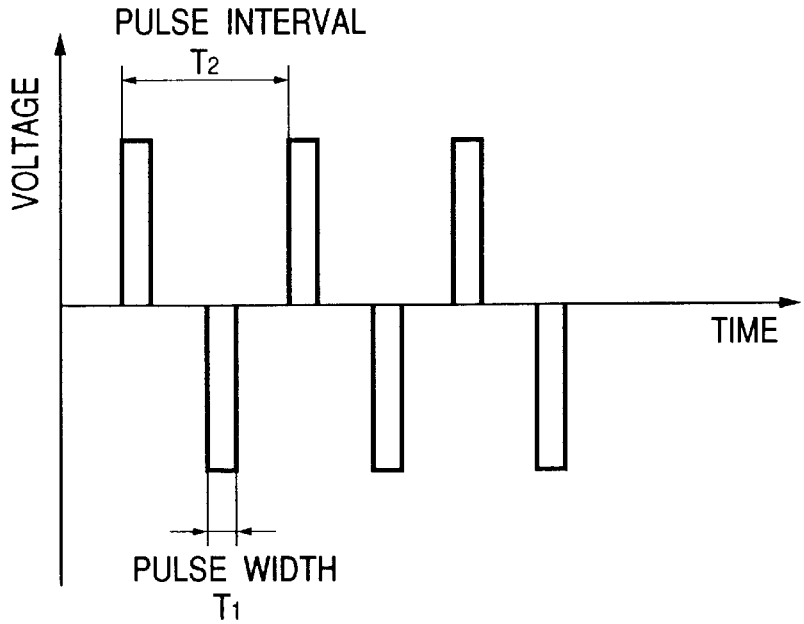
FIG. 3 is a graph showing one example of a voltage waveform suitable for the method of manufacturing the electron source in accordance with the present invention.

Subsequently, as shown in FIG. 1C, the first activation process will be performed. First, the substrate 61 forming an electron-emitting device thereon is disposed in the first vacuum container 11. The vacuum state of the first container 11 is formed where the exhaust apparatus 15 such as a vacuum pump discharges the air inside the container via the exhaust valve 14. Using an oil free pump such as a turbo molecule pump, a sputter ion pump, or a scroll pump as a vacuum pump is preferred. Further, the organic substance 16 is introduced into the vacuum container 11 via the gas introduction valve 13. After introducing a given concentration of organic substance into the vacuum container, by applying a voltage between the device electrodes 2 and 3 through the X-directional wiring 62 and the Y-directional wiring 63, the carbon film 6 of carbon or a carbon compound is deposited on the electroconductive film 4 and inside the first gap 5. A bipolar pulse voltage as shown in FIG. 3 is preferred as the voltage to be applied. The application of the pulse voltage can be made either by a method with a fixed wave-height value or a method with the wave-height increasing gradually with time.

Still further, in the first activation process, the introduction of organic substance may be performed after the substrate on which the electron-emitting devices are formed, is placed in the first vacuum container 11. Otherwise, the organic substance is introduced into the vacuum container 11 in advance, and then the substrate may be placed in the container. In either case, it is preferred that a voltage be applied after the concentration of the organic substance in the vacuum container has been stabilized.

The activation process can be performed by, for example, a method of applying a voltage for a given period of time or a method in which the value of a device current If that flows between the device electrodes 2 and 3 is measured at the time of voltage application, and the application of voltage is stopped when the value of the device current If reaches a predetermined value.

Note that the first activation process may also be a process in which without applying a voltage between the device electrodes 2 and 3, the electron-emitting device is exposed to an organic atmosphere so that the organic substance adheres onto the surface of the electroconductive film 4.

Figure 1D:
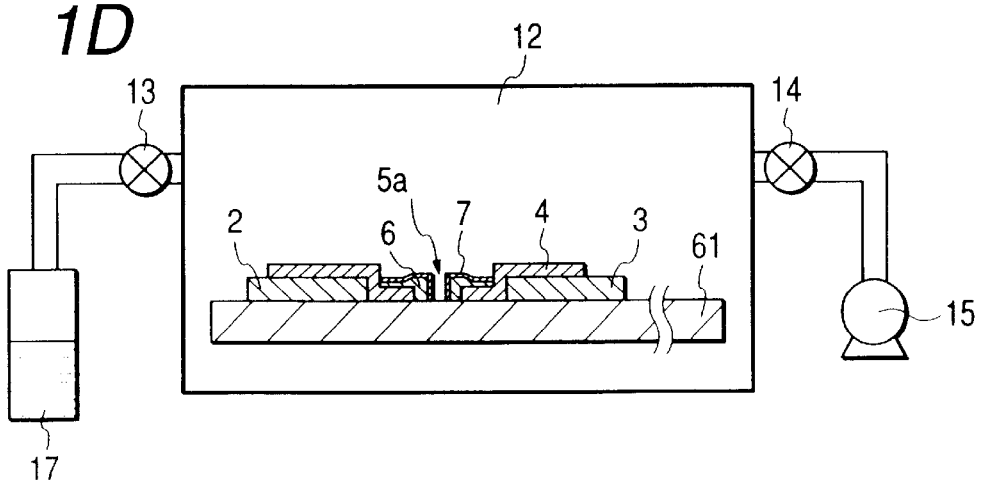

Next, as illustrated in FIG. 1D, the substrate 61 is moved into the second vacuum container 12, and then the second activation process is performed. The vacuum state of the second vacuum container 12 is formed by discharging the air inside the container by the exhaust device 15 such as the vacuum pump via the exhaust gas valve 14. It is preferred that as the vacuum pump the oil free pump such as the turbo molecule pump, the sputter ion pump, or the scroll pump be used. The organic substance 17 is also introduced into the vacuum container 11 via the gas introduction valve 13. After a predetermined concentration of an organic substance is introduced into the vacuum container, the carbon film of the carbon or the carbon compound 7 is deposited onto the electroconductive film 4 and into the first gap 5 by applying a voltage between the device electrodes 2 and 3 through the X-directional wiring 62 and the Y-directional wiring 63. In order to form the second gap 5*a* inside the first gap 5, carbon films 6 and 7 are deposited as shown in FIGS. 1C and 1D of the first activation process.

As shown in FIG. 3, the bipolar pulse voltage is preferable as the voltage to be applied. The method of applying pulse voltage can either be the method with a fixed wave-height value or the method with the gradual increase of the wave-height value with time. The applied voltage value, pulse width, method of applying a voltage, and the like can be carried out in the same manner as that of the first activation process or differently.

Even in the second activation process, the introduction of the organic substance may be done after the substrate on which the electron-emitting devices are formed, is placed in the second vacuum container 12. Otherwise, the organic substance is introduced into the vacuum container 12 in advance, and then the substrate may be placed in the container. In either case, it is preferred that voltage be applied after the concentration of the organic substance in the vacuum container has been stabilized.

The activation process can be performed by, for example, a method of applying a voltage for a given period of time or a method in which the value of a device current If that flows between the device electrodes 2 and 3 is measured at the time of voltage application, and the application of voltage is stopped when the value of the device current If reaches a predetermined value.

Figure 11:
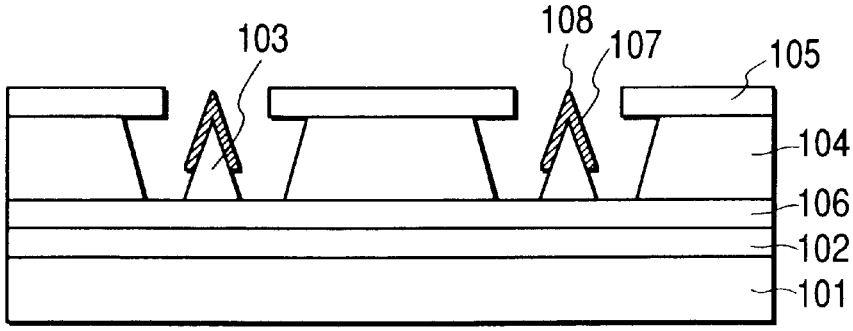
FIG. 11 is a cross-sectional view of the electron-emitting device in accordance with the present invention.

The manufacturing method of the present invention is also applicable for an FE type electron-emitting device. FIG. 11 is a schematic view showing an example of the FE type electron-emitting device to which the present invention can be applied, and FIG. 12 is a schematic view showing an example of a source electron provided with a substrate having a plurality of the FE type electron-emitting devices.

Figure 12:
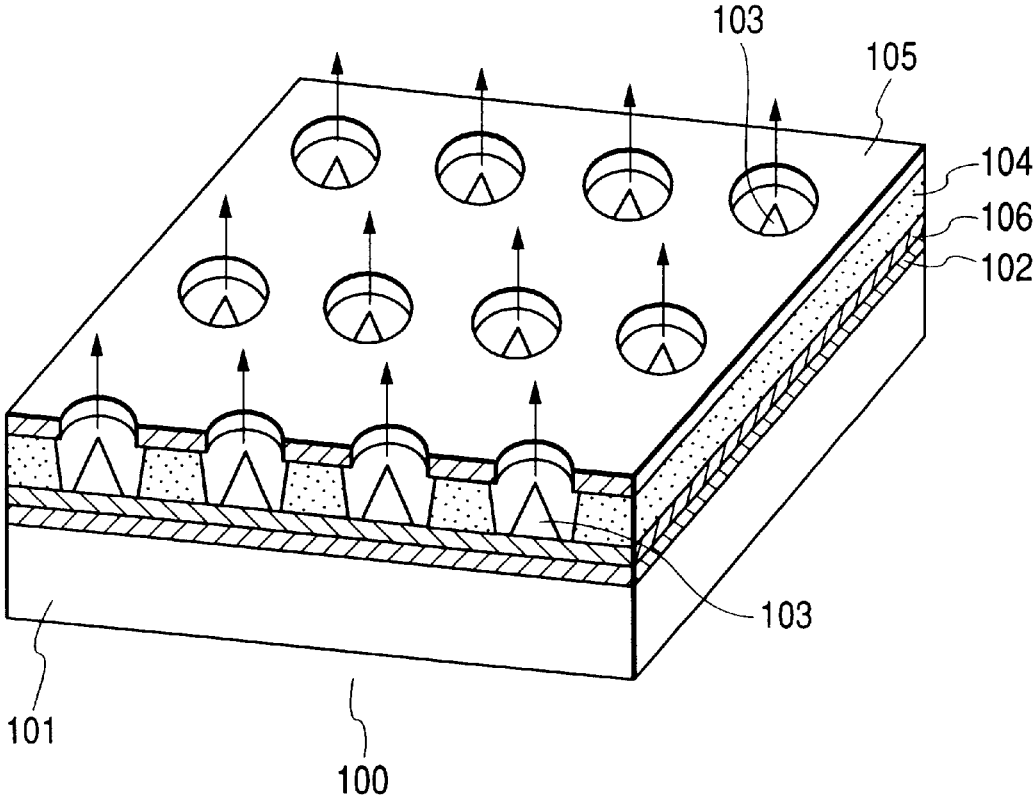
FIG. 12 is a schematic view showing another example of the electron source to which the present invention can be applied.

In FIGS. 11 and 12, reference numeral 100 denotes an electron source substrate; 101, a substrate; 102, a cathode electrode; 103, an emitter; 105, a gate electrode for drawing out electrons from the emitter; 104, an insulating layer for electrically insulating the cathode gate 102 and the gate electrode 105; 106, a resistance layer for an electric control; and 107 and 108, carbon films mainly composed of carbon or a carbon compound deposited on the whole surface or a part of the surface of the emitter 13.

By referring to FIGS. 13A to 13F, a representative manufacturing method for the above-mentioned FE type electron-emitting device will be explained.

Figure 13A:
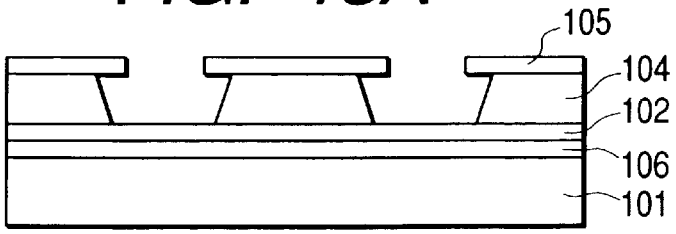
FIGS. 13A, 13B, 13C, 13D, 13E and 13F are cross-sectional views showing another example of the method of manufacturing the electron source in accordance with the present invention.

As shown in FIG. 13A, first, on the substrate 101 such as glass, the cathode electrode 102 made of metal film, the electric current resistance layer made from amorphous silicon etc., the insulating layer 14 made of silicon dioxide etc., and the gate electrode 105 made of molybdenum, niobium, etc. are formed one after another by sputtering or the evaporation method. Next, a resist pattern, corresponding to the location on which the emitter 13 will be formed, is formed on the gate electrode 105 by using the common lithography technology. Then, an opening portion having a diameter of several hundred nanometers to several micrometers is formed by etching. Thereafter, the resist pattern is removed after the insulating layer 104 located in correspondence with the opening portion of the gate electrode 105 is eliminated by hydrofluoric buffer.

Figure 13B:
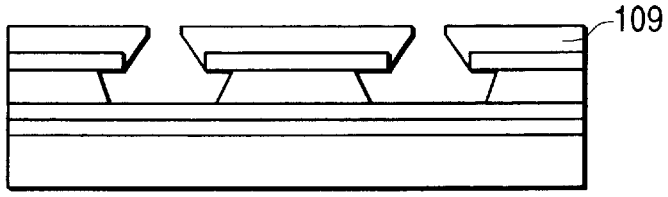

Then, as shown in FIG. 13B, metal layers made of aluminum etc. are formed by an oblique evaporation while rotating the substrate within a vacuum evaporation apparatus to form a mask layer 109 for forming the emitter.

Figure 13C:
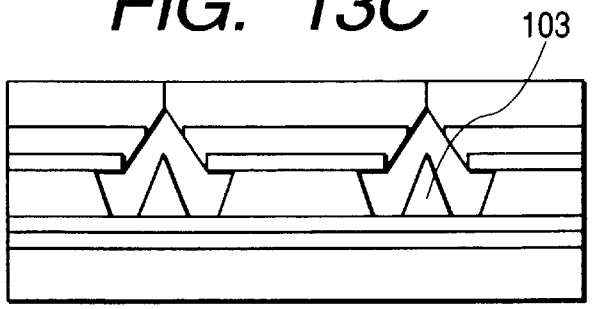

Next, as shown in FIG. 13C, when emitter materials made of molybdenum etc. are evaporated from a vertical direction of the substrate, a conical emitter 13 may be formed.

Figure 13D:
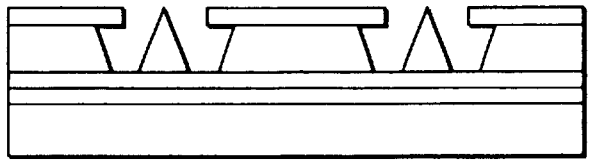

Subsequently, as shown in FIG. 13D, the mask layer 109 formed on the gate electrode 105 and the emitter material layer formed thereon are removed, thereby forming the FE type electron-emitting device.

Figure 13E:
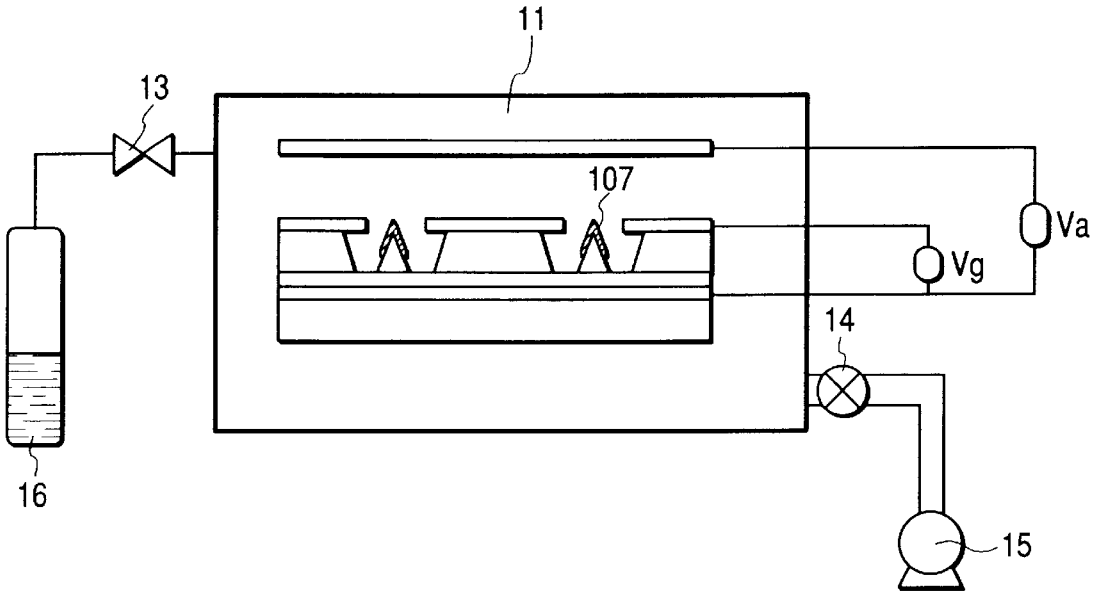

Shown in FIG. 13E is the first activation process of the FE type electron-emitting device.

First, the electrode source substrate 100 on which the FE type electron-emitting devices are formed, is placed in the first vacuum container 11. A vacuum state of the first vacuum container 11 is formed by discharging the air inside the container by the vacuum pump 15 via the exhaust valve 14. As the vacuum pump 15, the oil free pumps such as a turbo molecule pump, a sputter ion pump, and a scroll pump are preferred. Further, the organic substance 16 is introduced into the vacuum container 11 via the gas introduction valve 13.

In this manner, after introducing a given concentration of organic substance into the vacuum container 11, by applying a voltage between the cathode electrode 102 and the gate electrode 105 or between the cathode electrode 102 and an anode electrode 110 placed in the container, carbon or a carbon compound 107 is deposited on the surface of the emitter 103. At this time, an application of the pulse voltage can be made by either the method with a fixed-wave height value or the method with increasing a wave-height valued gradually with time.

The activation process can be performed by, for example, a method of applying a voltage for a given period of time or a method in which the value of electric current emitted from the emitter 103 is measured, and the application of voltage is stopped when the electric current value reaches a predetermined value.

Still further, in the first activation process, the introduction of organic substance may be performed after the electronic source substrate 100 is placed in the first vacuum container 11. Otherwise, the organic substance is introduced into the vacuum container 11 in advance, and then the substrate may be placed in the container. In either case, it is preferred that a voltage be applied after the concentration of the organic substance in the vacuum container has been stabilized.

Note that the first activation process may also be a process in which by exposing to an organic atmosphere, without applying a voltage, the organic substance is allowed to adhere onto the surface of the emitter 103.

Figure 13F:
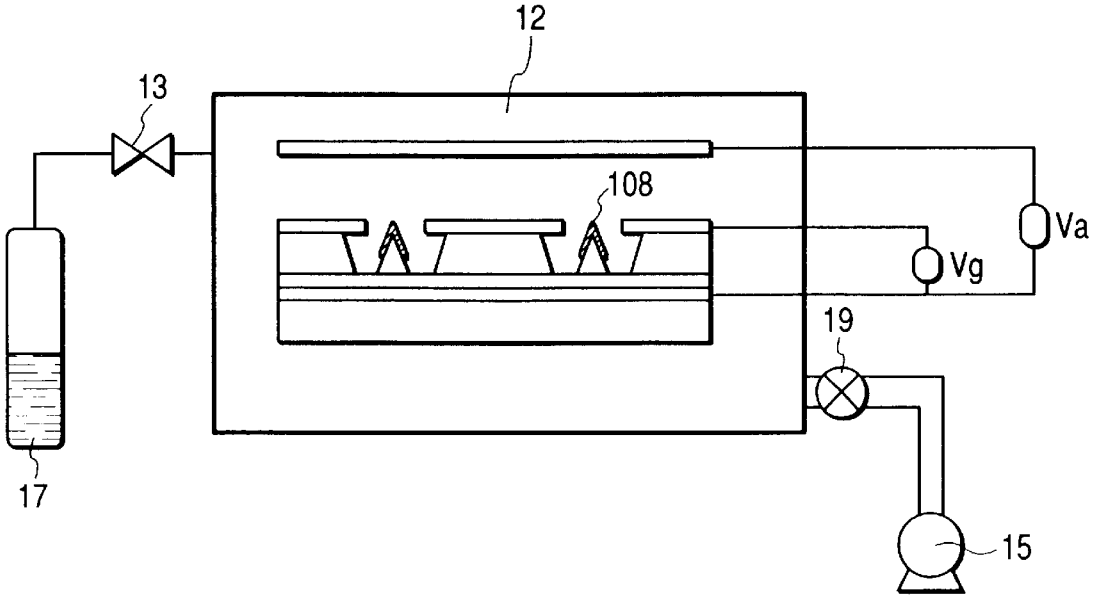

Next, as shown in FIG. 13F, the electron source substrate 100 is moved into the second vacuum container 12, and then the second activation process is performed. Into the second vacuum container is introduced the organic substance 17 via the gas introduction valve 13. In an atmosphere having organic substances, a voltage is applied between the cathode electrode 102 and the gate electrode 105 or between the cathode electrode 102 and the anode electrode 110 placed in the container, thus depositing carbon or a carbon compound 108 on the surface of the emitter 103. An application of a pulse voltage at this time can either be made by the method with a fixed wave-height value or the method with increasing a wave-height value gradually with time. The voltage to be applied, pulse width, frequency, method of applying voltage, and the like can be carried out in the same manner as that of the first activation process or differently.

Further, in the second activation process, the introduction of the organic substance may be done after the substrate 100 is placed in the second vacuum container 12. Otherwise, the organic substance is introduced into the vacuum container 12 in advance, and then the substrate may be placed in the container into which the organic substance is introduced. In either case, it is preferred that voltage be applied after the concentration of the organic substance in the vacuum container has been stabilized.

The activation process can be performed by, for example, a method of applying a voltage for a given period of time or a method in which the value of electric current emitted from the emitter 103 is measured, and the application of voltage is stopped when the electric current value reaches a predetermined value.

Examples of organic substances used in the activation process described above, include the aliphatic hydrocarbon groups such as alkane, alkene, or alkyne, aromatic hydrocarbon groups, alcohol groups, aldehyde groups, ketone groups, amine groups, nitrile groups, organic acid groups such as phenol, carbone, sulfonic acid. To be more specific, saturated hydrocarbons such as methane, ethane, and propane, which are represented by $CRTC_nH_{2n+2}$, unsaturated hydrocarbon such as ethylene, and propylene, which are represented by formula $C_nH_{2n}$ etc., benzene, toluene, methanol, ethanol, formaldehyde, acetaldehyde, acetone, methyl ethyl ketone, methylamine, ethylamine, phenol, benzonitrile, tornitrile, formic acid, acetic acid, propionic acid, and the like can be used.

In addition, as a diluent gas, an inert gas such as nitrogen, argon, or helium may be contained in the vacuum container other than the organic substances.

In the case where the partial pressures of the organic substances contained in each atmosphere of the first vacuum container 11 and the second vacuum container 12, are different from each other, there is the case that the kinds of the organic substances contained in the atmosphere of these vacuum containers are different from each other. For example, a method may be employed in which the partial pressure of the organic substances contained in the atmosphere of the first vacuum container 11 is made higher than the partial pressure of the organic substances in the atmosphere of the second vacuum container 12.

Thus, carbon or a carbon compound that becomes necessary to progress the first activation process within the first vacuum container under a high partial pressure atmosphere can be deposited on the electroconductive film and in the first gap. In this process step, though the amount of necessary organic substances is large, sufficient activation can be performed because an adequate amount of organic substances exists in the container. Subsequently, the second activation process is carried out within the second vacuum container under a low partial pressure atmosphere, thereby being capable of forming an electron-emitting region having satisfactory electron emitting characteristics on an electroconductive film. In this process step, though the amount of the organic substances existing in the container is small, the activation process has already been progressed to a certain level and the amount of organic substance needed for activation is also small, with the result that sufficient activation can be performed.

According to the present invention, since different vacuum containers are used for the activation, affects from the residual substances can be avoided and a reproductive activation can be performed even when the partial pressure shifts from high to low.

Further, a method that can be used is, for example, using organic substances in the atmosphere of the first vacuum container 11 with a higher steam pressure than the organic substances in the atmosphere of the second vacuum container 12.

In other words, since the first activation process uses a high steam pressure organic substance, the amount of the organic substance supplied per unit time to the first vacuum container can be easily increased. The first activation process can deposit carbon or a carbon compound on the electroconductive film, which is necessary for the progress of activation. In this process step, though the amount of organic substances required for the activation is large, sufficient activation can be performed because the amount of organic substances required are adequately supplied to the container.

Subsequently, the second activation process is carried out using a low steam pressure organic substance within the second vacuum container, resulting in the formation of an electron-emitting device having satisfactory electron emitting characteristics. This can be considered that an organic substance with low steam pressure forms carbon or a carbon compound that is inclined to be thermally stable. In this process step, since activation has progressed to a certain level and the amount of the organic substance needed is small, sufficient activation can be performed.

According to the present invention, since different vacuum containers are used for the activation, affects from the residual substances can be avoided and a reproductive activation can be performed even when the organic substances to be used are different from each other.

Note that the present invention is not limited to the above-mentioned embodiment. An appropriate method can be selected in response to the object and the kinds of organic substances to be used. In addition, three or more vacuum containers can optionally be used to perform three or more activation processes.

Next, a preferred stabilization process will be performed. This operation stabilizes the characteristics of the electron-emitting device by first sufficiently removing the molecules of the organic substance adsorbed to the electron-emitting device itself and its periphery. Thereafter, even if the electron-emitting device is operated, make sure not to deposit carbon or carbon compounds.

A more specific method is, for example, to place the electron source substrate in the vacuum container after the activation process. While using oil free exhausting apparatus such as an ion pump to discharge air, heating is performed to the electron source substrate and the vacuum container itself. This serves for eliminating the organic molecules adsorbed to the electron-emitting device and its periphery by raising temperature and for a sufficient removal. Either at the same time or after heating, there may be a case in which an increase in effect can be obtained when the evacuation of air is continuously done while applying a driving voltage to the electron-emitting device to emit electrons. Further, the same effect can be obtained depending upon the conditions such as kinds of organic substances to be introduced in the activation process and by driving the electron-emitting device in a vacuum container with a high vacuum. An appropriate method for the stabilization operation is performed in correspondence with the respective conditions. Note that the stabilization operation can be performed after assembling the image-forming apparatus described later.

Figure 10:
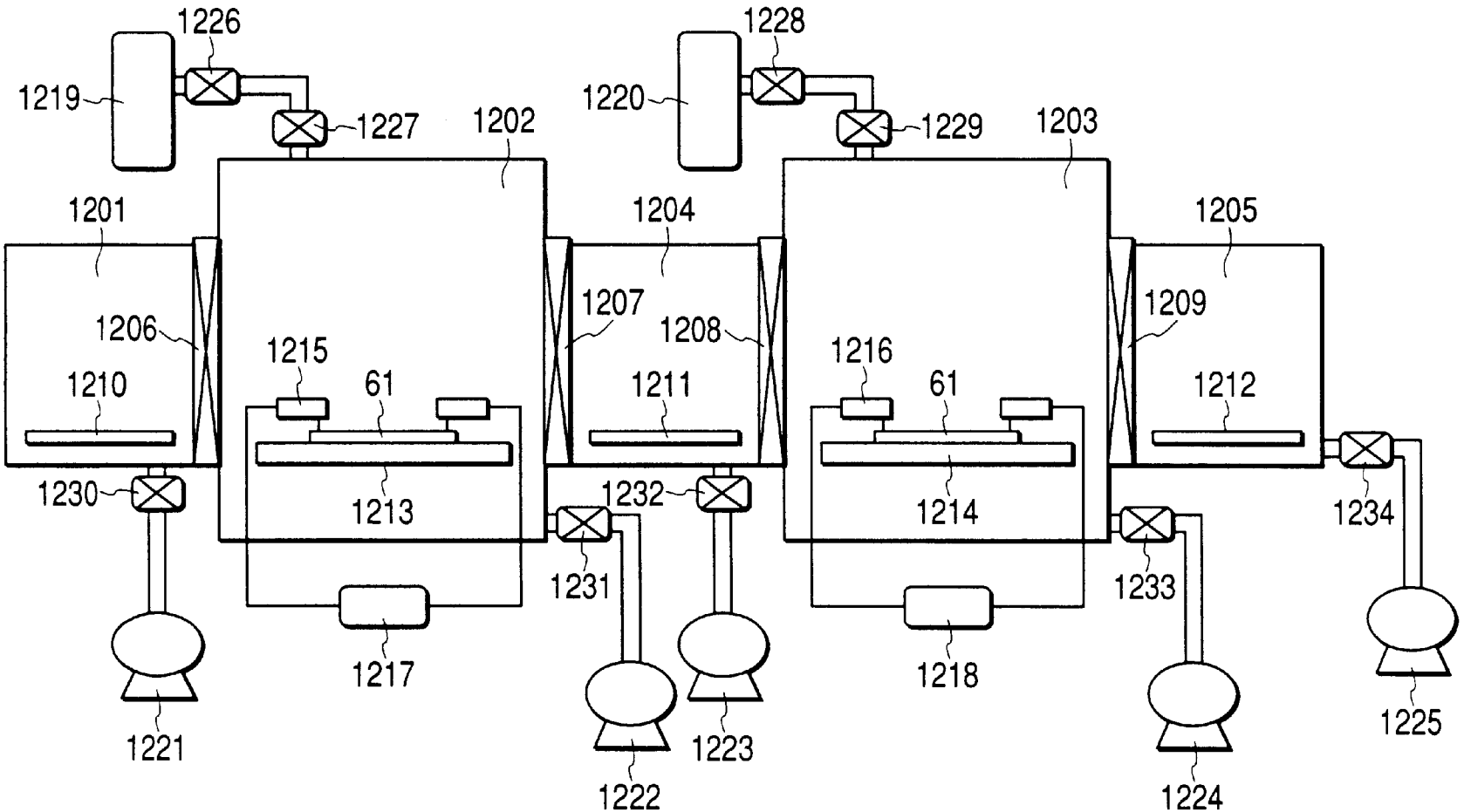
FIG. 10 is a block diagram showing the construction of an apparatus of manufacturing the electron source in accordance with the present invention.

Here, the entire structure of the activation apparatus is explained. As shown in FIG. 10, the activation apparatus is comprised of vacuum containers 1202 and 1203 for performing activation and an entry room 1201, a conveyer room 1204, and an exit room 1205 for conveying. Additionally, there is provided an exhausting means for evacuating the vacuum container, an introduction means for introducing activated substances into the vacuum container, and a voltage applying means for applying voltage to the wiring on the electron source substrate.

Activation is performed in the activation apparatus in the following order. That is, setting the electron source substrate 61 on a conveyer arm 1210 of the entry room 1201. After evacuating the entry room 1201 with an evacuation device 1221, open a gate valve 1206. The electron source substrate 61 is conveyed into the first vacuum container 1202 by the conveyer arm, and set on a support member 1213. Return the conveyer arm 1210 to the entry room 1201, and then close the gate valve 1206.

An evacuation device 1222 evacuates the first vacuum container 1202. Next, open a valve 1226 and a valve 1227 and an activation substance holding chamber 1219 introduces organic substance into the first vacuum container. The opening degree of the valve 1227 is regulated so that the pressure of the organic substance in the first vacuum container becomes the desired value. A voltage application probe 1215 then comes into contact with the X-directional wiring and the Y-directional wiring of the electron source substrate 61.

After the pressure of the organic substance in the first vacuum container has reached the desired value, the first activation process is performed by applying a voltage from a power source 1217 to the X-directional wiring and the Y-directional wiring of the electron source substrate 61. Note that the support member 1213 may have a heating mechanism or a cooling mechanism for regulating the substrate temperature.

After evacuating the conveyer room 1204 with an evacuation device 1223, next, open a gate valve 1207. The electron source substrate 61 is moved into the conveyer room 1204 using a conveyer arm 1211.

Close the gate valve 1207 and then open a gate valve 1208 after evacuating the conveyer room 1204 with the evacuation device 1223. The electron source substrate is conveyed into the second vacuum container 1203 using the conveyer arm 1211 and set on a support member 1214. Return the conveyer arm 1211 to the conveyer room 1204 and then close the gate valve 1208.

An evacuation device 1224 evacuates the second vacuum container 1203. Next, open a valve 1228 and a valve 1229 and an activation substance holding chamber 1220 introduces organic substance into the second vacuum container. The opening temperature of the valve 1226 is regulated so that the pressure of the organic substance in the second vacuum container becomes the desired value. A voltage application probe 1216 also comes into contact with the X-directional wiring and the Y-directional wiring of the electron source substrate 61. After the pressure of the organic substance in the second vacuum container has reached the desired value, the second activation process is performed by applying a voltage from a power source 1218 to the X-directional wiring and the Y-directional wiring of the electron source substrate 61. Note that the support member 1214 may have a heating mechanism or a cooling mechanism for regulating the substrate temperature.

Next, after evacuating the exist room 1205 with an evacuation device 1225 next, open a gate valve 1209. The electron source substrate 61 is moved into the conveyer room 1205 with a conveyer arm 1212. Then, close the gate valve and after purging the exist room 1205 with atmospheric pressure, take out the electron source substrate 61.

By changing the partial pressure and the kinds of organic substances in the first vacuum container and the second vacuum container in this activation apparatus, activation can be performed one after another in the vacuum containers of different atmosphere.

In addition, the activation apparatus is not limited to two vacuum containers, but three or more vacuum containers can be provided.

Figure 14:
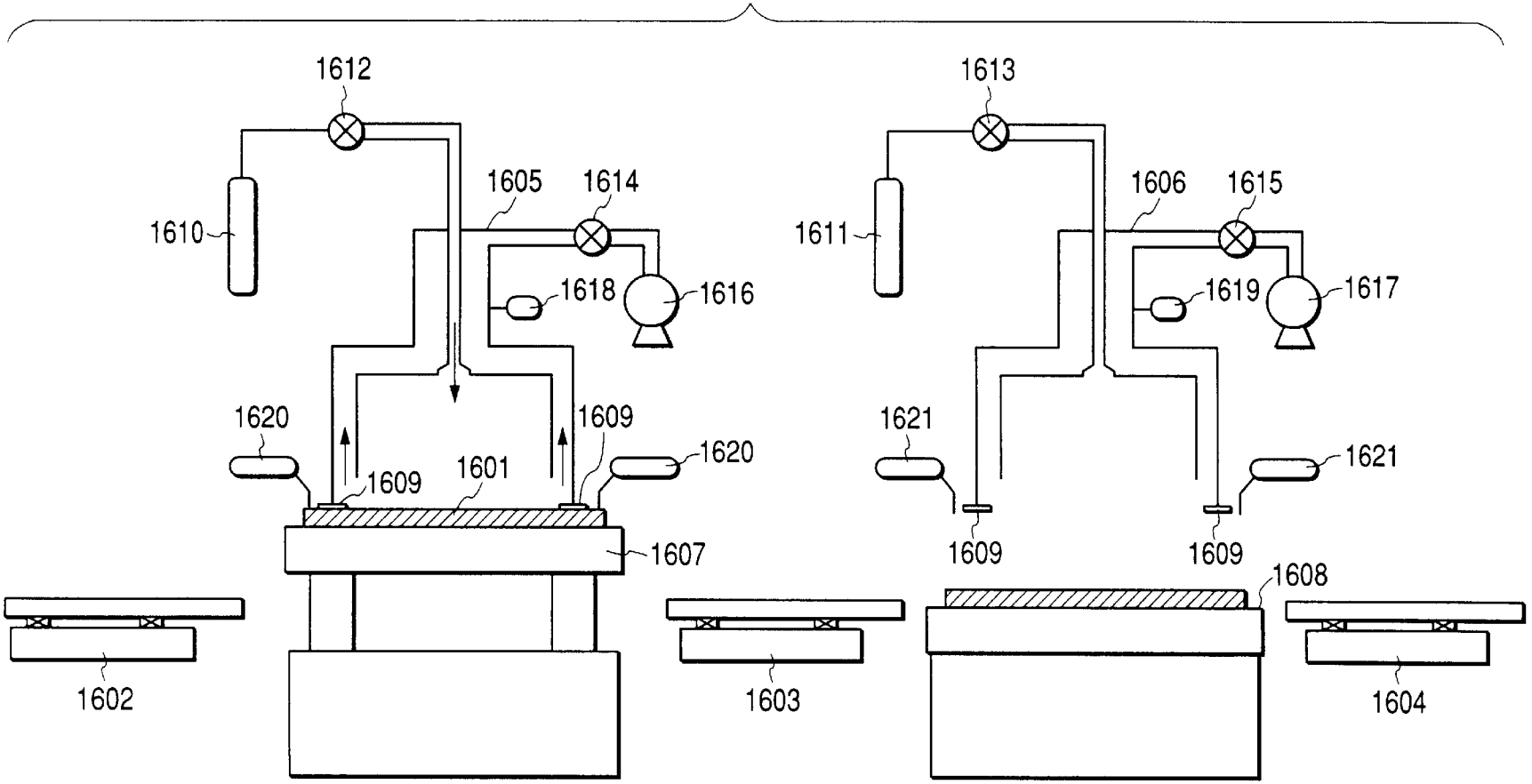
FIG. 14 is a view showing another construction of the apparatus of manufacturing the electron source in accordance with the present invention.
Figure 15A:
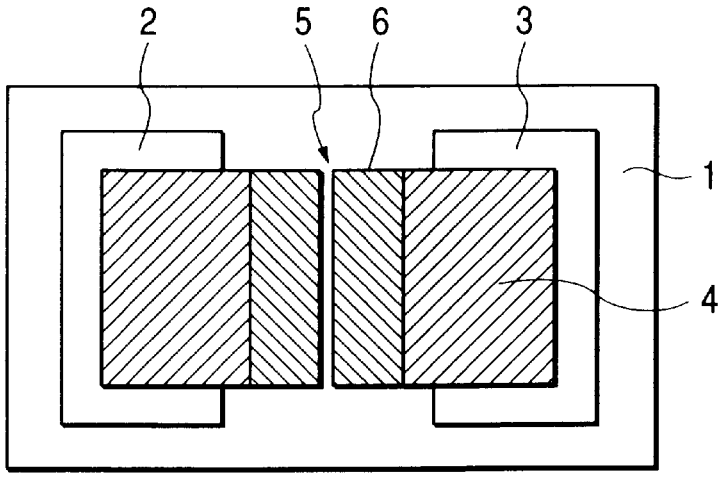
FIGS. 15A and 15B are respectively a plan view and a cross-sectional view showing a constructional example of a conventional electron-emitting device.
Figure 15B:
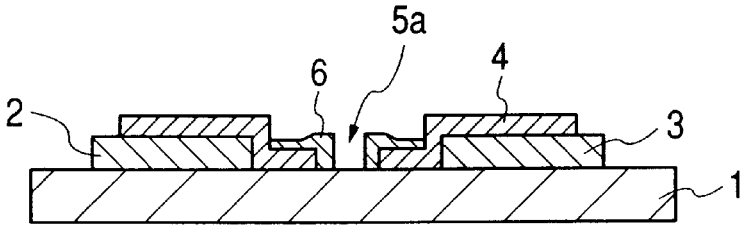
Figure 17:
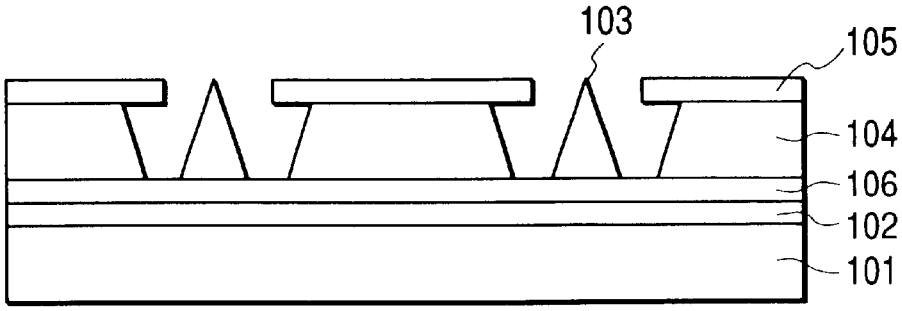
FIG. 17 is a cross-sectional view showing another constructional example of the conventional electron-emitting device.
Figure 16A:
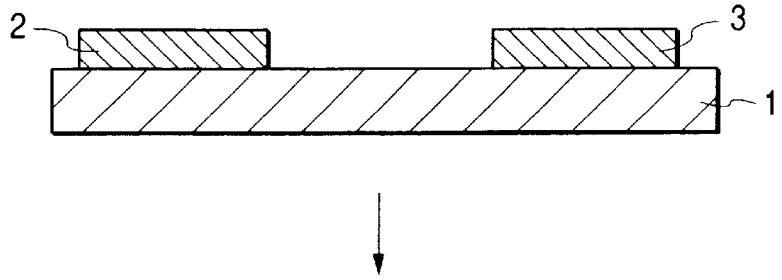
FIGS. 16A, 16B, 16C and 16D are cross-sectional views showing a method of manufacturing the conventional electron-emitting device.
Figure 16B:
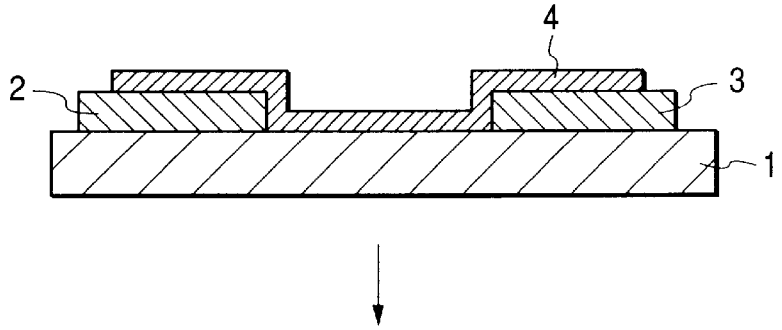
Figure 16C:
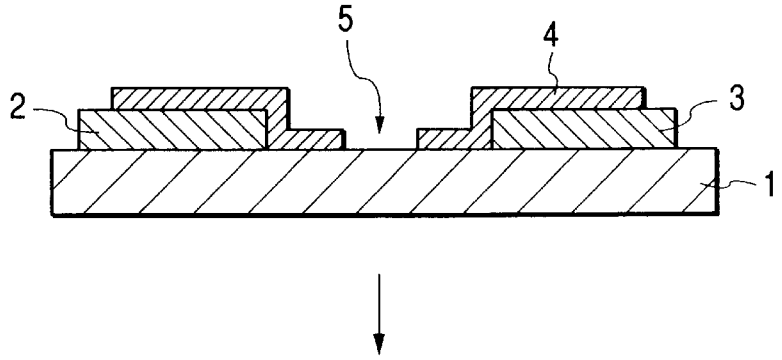
Figure 16D:
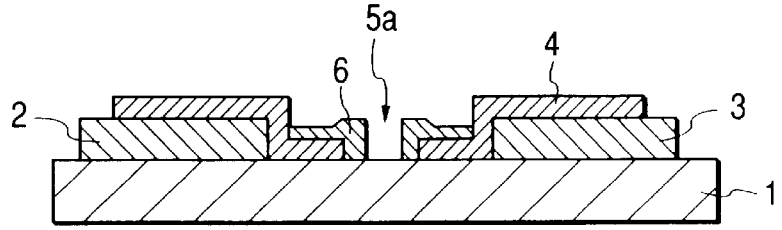

Referring to FIG. 14, another embodiment of the activation apparatus according to the present invention will be explained.

This activation apparatus is comprised of vacuum containers 1605 and 1606 for performing activation and conveying devices 1602, 1603, and 1604. In addition, there is provided an evacuation means for evacuating the vacuum container, an introduction means for introducing activated substances into the vacuum container, and a voltage applying means for applying voltage to the wiring on the electron source substrate. The activation apparatus is characterized in that the vacuum container includes the region where the electron-emitting device on the electron source substrate is formed and also its structure is formed like a covering for all the areas excluding the area where the output wiring is formed.

Activation of this activation apparatus is performed in the following order.

Set an electron source substrate 1601 on a conveyer arm 1602 for conveying. The electron source substrate 1601 is then placed and fixed on a support member 1607 by the conveyer arm 1602. The support member 1607 may be provided with a heating mechanism or a cooling mechanism for regulating the substrate temperature.

Next, the support member 1607 rises so that the first vacuum container 1605 and the electron source substrate 1601 come into contact. The gap between the first vacuum container 1605 and the substrate 1601 is airtight and maintained by a seal material 1609 such as O-ring materials. The first vacuum container 1605 also covers the electron-emitting device region formed on the electron source substrate 1601. Furthermore, a portion of the output wiring is designed so that it comes out of the vacuum container 1601.

Next, open a gate valve 1614 and after evacuating the inside of the first vacuum container 1605 with an evacuation device 1616, open a gate valve 1612. An activation substance holding chamber 1610 introduces organic substance into the first vacuum container. The opening degree of a valve 1612 is regulated so that the pressure of the organic substance in the first vacuum container becomes the desired value. A voltage application probe 1620 also comes into contact with the output wiring of the X-directional wiring and the Y-directional wiring of the electron source substrate 1601. Instead of connecting the probe, mount the output wiring on a flexible cable and connect this flexible cable to a power source. After the pressure of the organic substance in the first vacuum container has reached the desired value, the first activation process is performed by applying a voltage from a power source (not shown) to the X-directional wiring and the Y-directional wiring of the electron source substrate 1601.

Next, drop the support member 1607 and the electron source substrate 1601 is then moved and fixed onto a support member 1608 using the conveyer arm 1603. The support member 1608 may be provided with a heating mechanism or a cooling mechanism for regulating the substrate temperature.

Next, the support member 1608 rises so that the second vacuum container 1606 and the electron source substrate 1601 come into contact. The gap between the second vacuum container 1605 and the substrate 1601 is airtight and maintained by the seal material 1609 such as O-ring materials. The second vacuum container 1606 also covers the electron-emitting device region formed on the electron source substrate 1601. Furthermore, a portion of the output wiring is designed so that it comes out of the vacuum container 1606.

Open a gate valve 1615 and after evacuating the inside of the second vacuum container 1606 with an evacuation device 1617, then open a gate valve 1613. An activation substance holding chamber 1611 introduces organic substance into the second vacuum container. The opening degree of a valve 1613 is regulated so that the pressure of the organic substance in the second vacuum container becomes the desired value. A voltage application probe 1621 also comes into contact with the output wiring of the X-directional wiring and the Y-directional wiring of the electron source substrate 1601. Instead of connecting the probe, mount the output wiring on a flexible cable and connect this flexible cable to a power source. After the pressure of the organic substance in the second vacuum container has reached the desired value, the second activation process is performed by applying a voltage from a power source (not shown) to the X-directional wiring and the Y-directional wiring of the electron source substrate 1601. Next, drop the support member 1608 and use the exist conveyer arm 1604 to take out the electron source substrate 1601.

In the activation apparatus, modification in partial pressure of the organic substances or change in kinds of the organic substances contained in the first vacuum container and the second vacuum container will allow the activation operation to be in turn performed in the vacuum container of different atmospheres. Further, in the activation apparatus of the present invention, since the output wiring portion of the electron source substrate is external to the vacuum container, the output wiring can be easily aligned with the voltage application probe. Further, a flexible cable can be previously mounted on the output wiring. Hence, the present invention has the effect that a voltage can be applied in a more convenient and simple manner.

Still further, the number of the vacuum containers in the activation apparatus is not limited to two, and three or more vacuum containers may be available.

Furthermore, an electron source substrate on which a plurality of the electron-emitting devices having the foregoing structure are formed can be combined with an image-forming member comprised of phosphors, etc. to constitute an image-forming apparatus.

Figure 7:
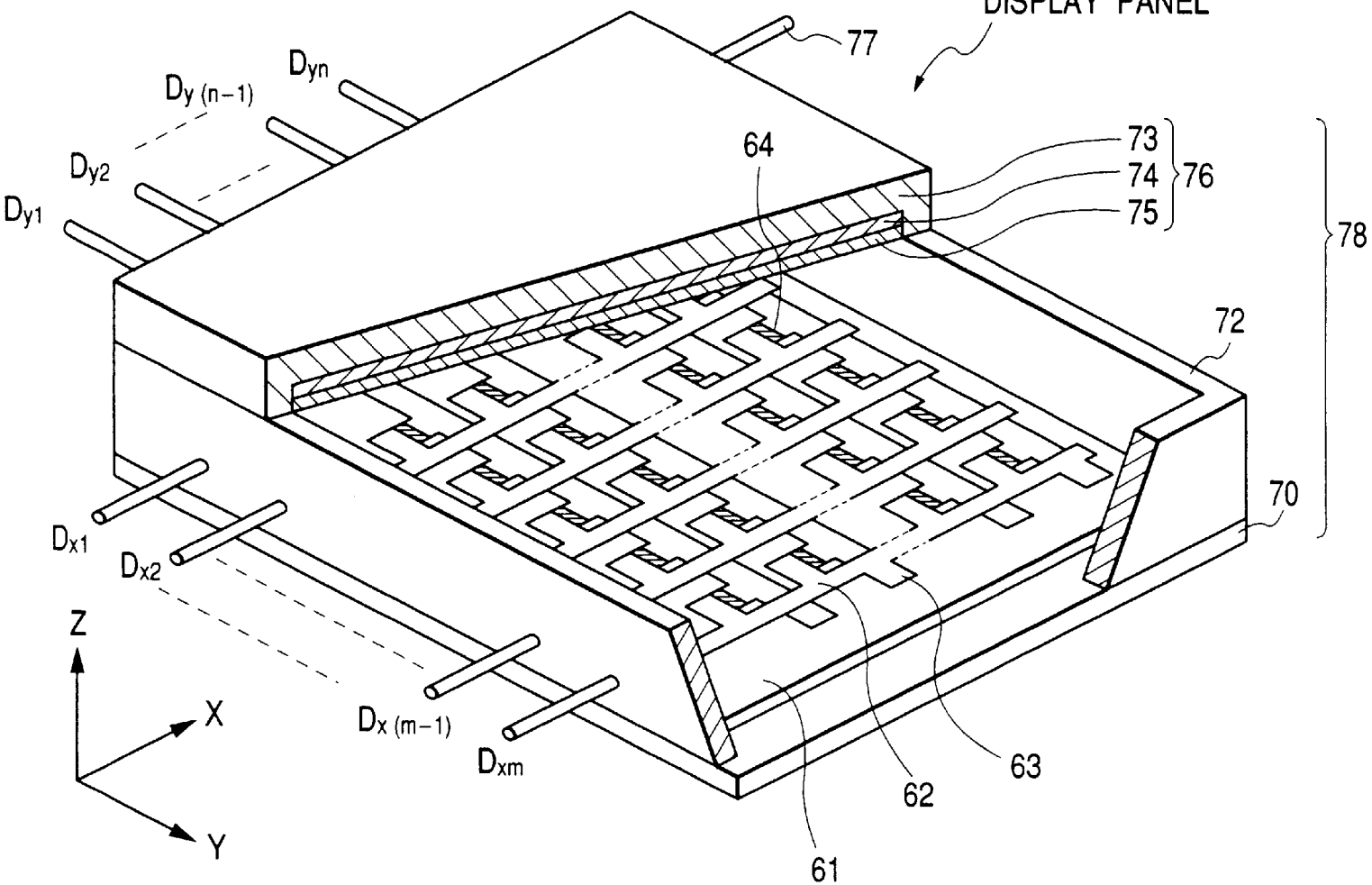
FIG. 7 is a partially broken perspective view showing one example of a display panel of an image-forming apparatus to which the present invention can be applied.

Now, an image-forming apparatus to which an electron source made according to the present invention can be applied will be described with reference to FIG. 7. FIG. 7 is a view showing the basic structure of the image-forming apparatus. In FIG. 7, reference numeral 61 denotes an electron source substrate on which a plurality of electron-emitting devices are mounted; 71, a rear plate to which the electron source substrate 61 is fixed; and 76, a face plate having a fluorescent film 74, a metal back 75 and the like formed on the inner surface of a glass substrate 73. Reference numeral 72 denotes a supporting frame. The rear plate 71, the supporting frame 72 and the face plate 76, which are coated with frit glass, are burned in the atmosphere or in the nitrogen atmosphere at 400° C. to 500° C. for 10 minutes or more and thus sealed. An envelope 78 is thus formed.

In FIG. 7, reference numeral 64 corresponds to the electron-emitting devices shown in FIG. 2. Reference numerals 62 and 63 respectively denote an X-directional wiring and a Y-directional wiring connected to a pair of device electrodes of each of the electron-emitting devices. The wiring to the device electrodes may be called a device electrode if the same material is used for the device electrodes and the wiring.

The envelope 78 comprises the face plate 76, the supporting frame 72, and the rear plate 71 as described above. However, since the rear plate 71 is intended to mainly increase an intensity of the substrate 61, the separate rear plate 71 may be eliminated if the substrate 61 itself has a sufficient intensity. In this case, the supporting frame 72 is directly sealed on to the substrate 61, and the envelope 78 can comprise the face plate 76, the supporting frame 72 and the substrate 61.

On the other hand, a not-shown supporting body called a spacer is disposed between the face plate 76 and the rear plate 71, whereby the envelope 78 with sufficient intensity against the atmosphere can be fabricated.

The envelope 78 is set to a vacuum of about $1\times10^{-5}$ Pa through a not-shown exhausting pipe, followed by sealing the envelope 78. The gettering may be performed to maintain a vacuum after the envelope 78 is sealed. This is a process to heat a getter placed at a not-shown predetermined position within the envelope 78 by a heating method such as resistive heating or high-frequency heating to form an evaporated film. Typically, a getter mainly contains Ba and the like, and serves to maintain a high vacuum due to the absorption effects of the evaporated film.

In the thus constructed image display device according to the present invention, a voltage is applied to the respective electron-emitting devices through out-of-container terminals Dox1 to Doxm or Doy1 to Doyn, allowing electrons to be emitted. A high voltage of several kV or more is applied to the metal back 75 or not-shown transparent electrodes through a high voltage terminal 77 to accelerate an electron beam, causing the beam to impinge to the fluorescent film 74, to be excited and to emit light. Therefore, images can be displayed.

The foregoing structure is an outlined structure necessary to manufacture an image-forming apparatus suitable for display, etc., and the specific contents on as material of each member are not limited to the foregoing description but may be suitably chosen for application of the image-forming apparatus.

The image-forming apparatus according to the present invention can also be employed as a display device for television broadcasting, a display device in a television conference system, a computer, etc. as well as an image-forming apparatus as an optical printer comprising photosensitive drum, etc.

Figure 8:
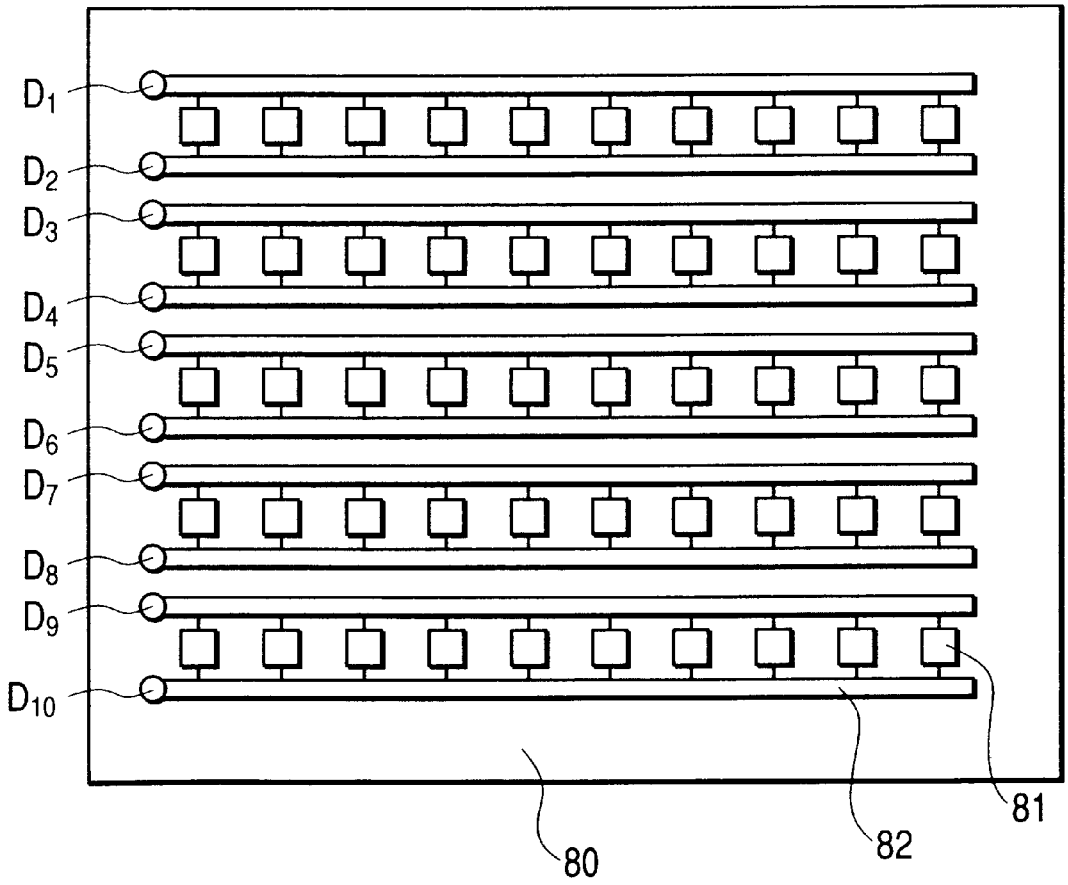
FIG. 8 is a plan view showing one example of the electron source in a ladder arrangement to which the present invention can be applied.

The electron source can be implemented using an electron source in a ladder arrangement as illustrated in FIG. 8. The electron source in a ladder arrangement and the image-forming apparatus will be described with reference to FIGS. 8 and 9.

FIG. 8 is a schematic view showing an example of the electron source in a ladder arrangement. In FIG. 8, reference numerals 80 and 82 denote an electron source substrate and electron-emitting devices, respectively. Reference numeral 82 denotes common wiring for connecting the electron-emitting devices 81 to one another, as designated by Dx1 to Dx10. The plural electron-emitting devices 81 are arranged in parallel in an X-direction on the substrate 80 (called device lines). A plurality of device lines are arranged to constitute an electron source. A driving voltage is applied between the common wiring of the respective device lines, so that the respective device lines can be independently driven. In other words, a voltage not larger than an electron-emitting threshold value is applied to the device lines at which an electron beam is to be emitted. The common wiring Dx2 to Dx9 between the respective device lines may be such that, for example, Dx2 and Dx3 are the same wiring.

Figure 9:
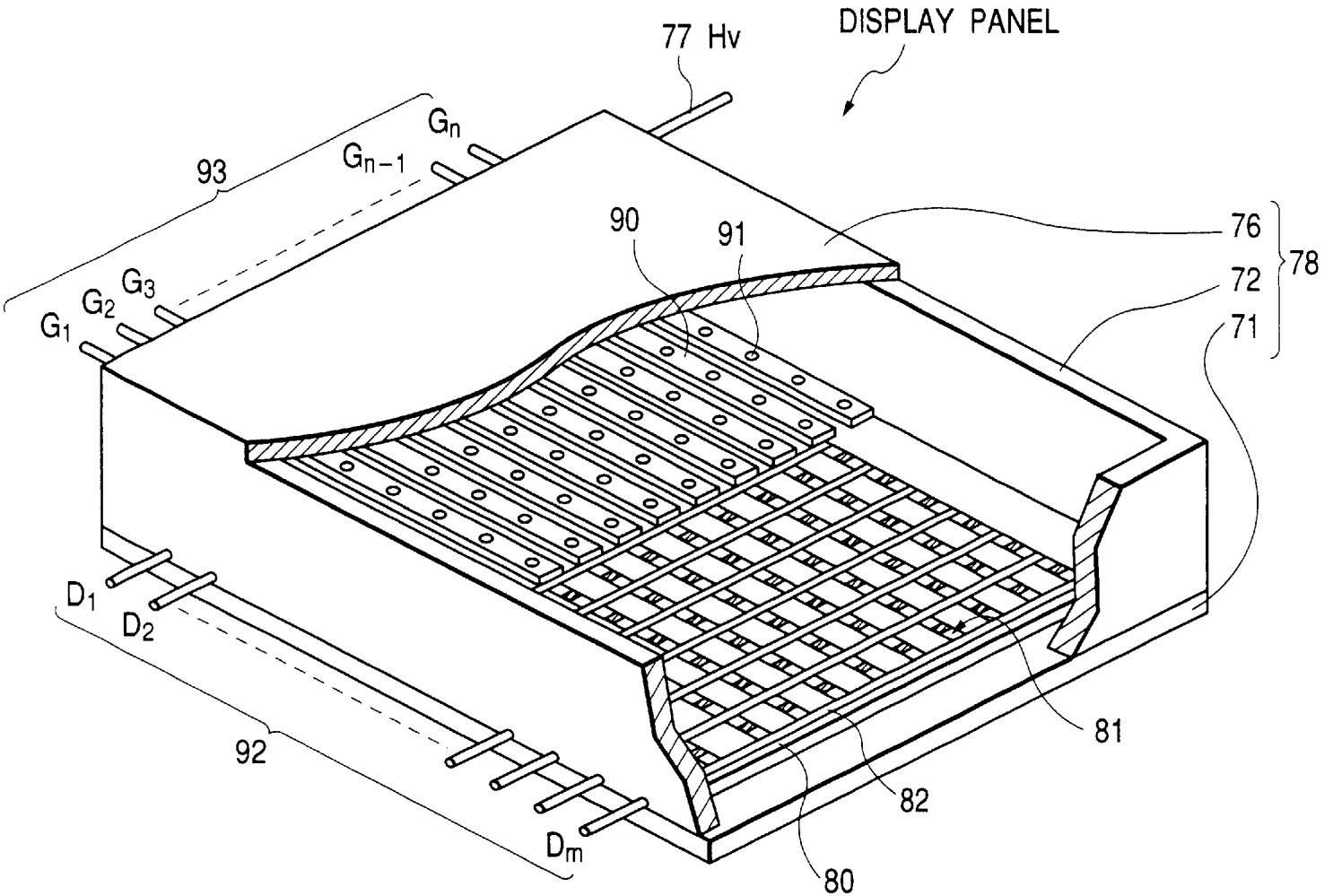
FIG. 9 is a partially broken perspective view showing one example of the display panel of the image-forming apparatus to which the present invention can be applied.

FIG. 9 is a schematic view showing an example of a panel structure in an image-forming apparatus equipped with the electron source in a ladder arrangement. Reference numeral 90 denotes a grid electrode; 91, openings through which electron passes; and 92, out-of-container terminals comprising Dox1, Dox2, . . . and Doxm. Reference numeral 93 denotes out-of-container terminals comprising G1, G2, . . . Gn connected to the grid electrode 90, and reference numeral 80 denotes an electron source substrate having the same common wiring between the respective device lines. In FIG. 9, the same portions as those shown in FIGS. 7 and 8 are designated by the same reference numerals as those depicted in the figures. The remarkable difference between the image-forming apparatus shown in FIG. 9 and the image-forming apparatus arranged in a simple matrix as shown in FIG. 7 is whether or not the grid electrode 90 is provided between the electron source substrate 80 and the face plate 76.

In FIG. 9, the grid electrode 90 is provided between the substrate 80 and the face plate 76. The grid electrode 90 serves to modulate an electron beam emitted from the surface conduction electron-emitting device, and is provided with individual circular openings 91 respectively corresponding to the devices to pass electron beams through stripe-type electrodes that are orthogonal to the device lines in a ladder arrangement. The grid shape and installation position are not limited to that shown in FIG. 9. For example, a multiple through-holes may be formed as openings in a mesh manner, and the grid may be provided around or near to the surface conduction electron-emitting device. The out-of-container terminals 92 and the out-of-container terminals 93 are electrically connected to a not-shown control circuit.

In this image-forming apparatus, as the device lines are in turn driven (scanned) line by line, in synchronization therewith, a modulation signal of one line of image is applied to rows of the grid electrodes. As a result, irradiation of each electron beam to the phosphors can be controlled so that images can be displayed line by line.

In case of the electron source substrate equipped with the PE-type electron-emitting device shown in FIG. 12, the electron source substrate and the above-noted face plate are also sealed via the supporting frame to form a vacuum container. Hence, the image-forming apparatus is formed.

The image-forming apparatus according to the present invention can also be employed as a display device for television broadcasting, a display device in a television conference system, a computer, etc. as well as an image-forming apparatus as an optical printer comprising photosensitive drum, etc.

A more detailed explanation of the present invention is given by the embodiments below.

Embodiment 1

Embodiment 1 is an example of manufacturing an electron source in which multiple electron-emitting devices are arranged into a simple matrix. First, a matrix shape electron source substrate 61 as shown in FIG. 6 is manufactured as below. The number of devices in the X-direction is 900 devices, with 300 devices in the Y-direction.

Step (a)

A 600 nm thick $SiO_2$ layer is formed by CVD on a soda lime glass substrate. A Pt paste is printed on the $SiO_2$ layer by offset printing and is then baked, forming device electrodes 2 and 3 with a thickness of 50 nm. The inter-electrode distance between the device electrodes 2 and 3 is set to 30 $\mu$m.

Step (b)

An Ag paste is printed by screen printing and is then baked, forming a Y-direction wiring 63. An insulating paste is next printed by screen printing at the intersection between an X-direction wiring 62 and the Y-direction wiring 63, and this is then baked, forming an insulating layer 65 with a thickness of 30 $\mu$m. Further, an Ag paste is printed by screen printing and is then baked, forming the X-direction wiring 62.

Step (c)

A palladium complex solution is dripped between the device electrodes 2 and 3 by using a bubble jet type injection device. Heat treatment is then performed at 350° C. for 30 minutes, forming an electroconductive thin film 4 from a palladium oxide fine powder. The film thickness of the electroconductive thin film 4 is 15 nm. The composition of the palladium complex solution is: 0.15 wt % palladium acetate mono-ethanol amine complex (Pd equivalent), 25 wt % IPA, 1 wt % ethylene glycol, 0.05 wt % PVA, and pure water.

Step (d)

Figure 5:
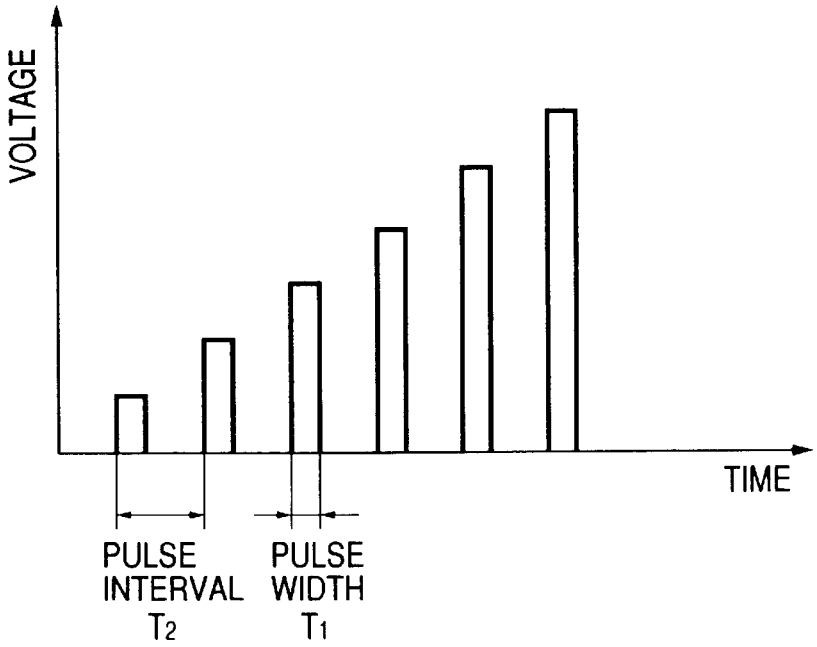
FIG. 5 is a graph showing another example of the voltage waveform suitable for the method of manufacturing the electron source in accordance with the present invention.

The formed electron source substrate 61 is set into a vacuum container. After evacuating the inside of the vacuum container with an evacuation device to $1\times10^{-3}$ Pa, nitrogen gas mixed with 2% hydrogen is introduced. A voltage is applied between each electron-emitting device and the electrodes 2 and 3, by an electrode not shown in the figures, through the X-direction wiring 62 and the Y-direction wiring 63, and a forming operation is performed on the electroconductive thin film 4. The voltage waveform for the forming operation is the waveform of FIG. 5, and the applied voltage is 10 V.

Step (e)

Next, after forming is completed, activation of the electron source substrate 61 is performed using the activation device shown in FIG. 10.

First, the electron source substrate 61 is set on a conveyor arm 1210 of an entry room 1201 of the activation device. After evacuating the inside of the entry room 1201 for several minutes with an evacuation device 1221, a gate valve 1206 is opened. The electron source substrate 61 is conveyed to the inside of a first vacuum container 1202 by using the conveyer arm 1210, and is set on a support member 1213. The conveyor arm 1210 is returned to the entry room 1201, and the gate valve 1206 is closed.

With the first vacuum container 1202 in an evacuated state by using an evacuation device 1222, a valve 1226 and a valve 1227 are opened, and tornitrile is introduced into the first vacuum container from an activation substance holding chamber 1219. The valve 1227 opening is regulated so that the partial pressure of tornitrile inside the first vacuum container becomes $1\times10^{-2}$ Pa.

A voltage application probe 1215 is then contacted with the X-direction wiring and with the Y-direction wiring of the electron source substrate 61, and a first activation is performed by applying a voltage to the X-direction wiring and to the Y-direction wiring of the electron source substrate 61 from a power source 1217. The voltage application is performed by connecting all of the Y-direction wirings to a common ground, and applying a voltage to selected lines of the X-direction wirings. The applied voltage is 16 V, the voltage waveform is the waveform shown in FIG. 3, T1 is set to 1 msec, T2 to 20 msec, and the application time is 1 minute.

Step (f)

Next, after evacuating the inside of a conveyor room 1204 for several minutes by using an evacuation device 1223, a gate valve 1207 is opened, and the electron source substrate 61 is moved inside the conveyor room 1204 using a conveyer arm 1211.

The gate valve 1207 is closed, and after evacuating the inside of the conveyor room 1204 for several minutes by using the evacuation device 1223, a gate valve 1208 is opened. The electron source substrate 61 is then conveyed to the inside of a second vacuum container 1203 by using the conveyor arm 1211, and set on a support member 1214. The conveyor arm 1211 is returned to the conveyor room 1204, and the gate valve 1208 is closed.

With the second vacuum container 1203 in an evacuated state by using an evacuation device 1224, a valve 1228 and a valve 1229 are opened, tornitrile is introduced into the second vacuum container from an activation substance holding chamber 1220. The valve 1229 opening is regulated so that the partial pressure of tornitrile inside the second vacuum container becomes $1\times10^{-4}$ Pa.

A voltage application probe 1216 is then contacted with the X-direction wiring and with the Y-direction wiring of the electron source substrate 61, and a second activation is performed by applying a voltage to the X-direction wiring and to the Y-direction wiring of the electron source substrate 61 from a power source 1218. The voltage application is performed by connecting all of the Y-direction wirings to a common ground, and applying a voltage to selected lines of the X-direction wirings. The applied voltage is 16 V, the voltage waveform is the waveform shown in FIG. 3, T1 is set to 1 msec, T2 to 20 msec, and the application time is 15 minutes.

Next, after evacuating the inside of an exit room 1205 for several minutes by using an evacuation device 1225, a gate valve 1209 is opened, and the electron source substrate 61 is moved inside the exit room 1205 using a conveyer arm 1212.

The gate valve 1209 is closed, and after purging the inside of the exit room 1205 to atmospheric pressure, the electron substrate 61 is removed.

The device current If during activation is increased smoothly in Embodiment 1, and the value of the device current If at the time of the activation for each device is on the order of 1.6 mA. Further, the activation profiles (the relationship between activation time and device current If) of the first activated line and the last activated line are nearly equal, and therefore all of the electron-emitting devices can be similarly activated. Furthermore, the activation profile is nearly identical after performing activation of five electron source substrates in succession, and therefore activation can be performed with good repeatability.

Comparative Example 1

The first activation process and the second activation process are performed using the same vacuum container as a comparative example.

An electron source substrate is prepared, similar to Embodiment 1, and forming is performed.

The substrate is then set in the vacuum container 1202 of the activation device of FIG. 10, similar to Embodiment 1. After evacuating the inside of the vacuum container 1202, the valve 1226 and the valve 1227 are opened, and tornitrile is introduced into the vacuum container from the activation substance holding chamber 1219. The valve 1227 opening is regulated so that the partial pressure of tornitrile inside the vacuum container becomes $1\times10^{-2}$ Pa. A voltage is then applied, similar to Embodiment 1, and the first activation is performed.

The valve 1226 and the valve 1227 are then closed, and after evacuating the inside of the vacuum container 1202 until the pressure becomes $5\times10^{-6}$ Pa or less, the valve 1226 and the valve 1227 are once again opened, and tornitrile is introduced into the vacuum container from the activation substance holding chamber 1219. The valve 1227 opening is regulated so that the partial pressure of tornitrile inside the vacuum container becomes $1\times10^{-4}$ Pa. A voltage is then applied, similar to Embodiment 1, and after performing the second activation, the substrate is removed.

The device current If during activation is increased smoothly in Comparative Example 1. However, when compared to the activation profile of the second activation process, the rate of increase of the device current If (amount of increase in If/time) five minutes after activation causes the lines activated in the initial stage to be slightly larger than the lines activated later, and a condition is seen in which the lines activated in the initial stage of the second activation process are affected by organic matter remaining from the first activation process.

Embodiment 2

Embodiment 2 is an example of an image-forming apparatus shown in FIG. 7 in which an electron source manufactured in accordance with the present invention is applied. After the electron source substrate 61 manufactured in Embodiment 1 stated above is fixed onto a rear plate 71, a face plate 76 is fixed 3 mm above the substrate through a support frame 72 and an exhaust pipe not shown in the figures, forming an envelope 78. Further, spacers not shown in the figures are set between the rear plate and the face plate, making a structure able to withstand atmospheric pressure. Furthermore, a getter is placed inside the envelope 78 in order to keep the container in high vacuum. A frit glass is used in the bonding of the rear plate, the support frame, and the face plate, and bonding is performed by heat to 420° C. in an argon atmosphere.

The entire panel is then heated to 250° C. while evacuating the atmosphere inside the manufactured envelope 78 through the exhaust pipe by using a vacuum pump. After the temperature has fallen to room temperature and the internal pressure is on the order of $10^{-7}$ Pa, sealing of the envelope 78 is performed by welding the exhaust pipe by heating with a gas burner. Lastly, the getter is heated by high frequency heating, performing a gettering operation in order to maintain the pressure after sealing. Thus the image-forming device as shown in FIG. 7 is manufactured.

Electrons are emitted by applying a voltage of 14.5 V to each electron-emission device in the image-forming device completed as above, through external terminals Dox1 through Doxm, and Doy1 through Doyn. Further, a 1 kV high voltage is applied to a metal back 75 through a high voltage terminal 77. If the electron emission ratio Ie/If is measured at this point, where If is the device current flowing in the electron emission device, and Ie is the emission current emitted from the electron-emission device and arriving at the metal back 75, then the electron emission ratio is approximately 0.16%, having good electron emission characteristics.

A 6 kV high voltage is next applied to the metal back 75 through the high voltage terminal 77, and the emitted electrons are collided with a fluorescent film 74, and an image is displayed by excitation and emission of light. The image display device of Embodiment 2 has no noticeable dispersion in luminescence or uneven colors, and can display a good image which sufficiently satisfies its use as a television.

Embodiment 3

Embodiment 3 is an example of another method of manufacture of an electron source.

An electron source substrate is formed in accordance with steps (a) to (d) of Embodiment 1. Flexible cables are mounted on the output lines of the X-direction wiring and the Y-direction wiring of the formed electron source substrate. Forming is then performed, similar to step (e) of Embodiment 1, forming an electron-emitting region.

Next, activation of the electron source substrate 61 on which forming has been completed is performed using the activation device shown in FIG. 14.

The electron source substrate 61 is first set on a conveyor arm 1602 used for entry, and the electron source substrate 61 is then placed and fixed on a support member 1607 by using the conveyor arm 1602.

The support member 1607 is then raised, and the electron source substrate 61 and a first vacuum container 1605 are brought into contact. An airtight seal is maintained by an o-ring between the first vacuum container 1605 and the substrate 61.

A valve 1614 is opened next, and after evacuating the inside of the first vacuum container 1605 by an evacuation device 1616, a valve 1612 is opened. Tornitrile is introduced into the first vacuum container from an activation substance holding chamber 1610, and the valve 1612 opening is regulated so that the partial pressure of tornitrile inside the first vacuum container becomes $1\times10^{-3}$ Pa.

Next, a power source not shown in the figures is connected to the flexible cable connected to the output lines of the X-direction wiring and the Y-direction wiring of the electron source substrate 61, and a first activation is performed by applying a voltage to the X-direction wiring and to the Y-direction wiring. The voltage application is performed by connecting all of the Y-direction wirings to a common ground, and applying a voltage to selected lines of the X-direction wirings. The applied voltage is a bipolar voltage waveform, similar to that of Embodiment 1, and the wave height of the applied voltage is increased from 10 V to 16 V at a rate of 0.1 V/sec for 1 minute, after which 16 V is applied for another 1 minute.

The support member 1607 is then lowered, and the electron source base 61 is moved to a support member 1608 by using a conveyor arm 1603, and fixed in place.

The support member 1608 is then raised, and the electron source substrate 61 and a second vacuum container 1606 are brought into contact. An airtight seal is maintained by an o-ring between the second vacuum container 1606 and the substrate 61.

A valve 1615 is opened next, and after evacuating the inside of the second vacuum container 1606 by an evacuation device 1617, a valve 1613 is opened. Tornitrile is introduced into the second vacuum container from an activation substance holding chamber 1611, and the valve 1613 opening is regulated so that the partial pressure of tornitrile inside the second vacuum container becomes $1\times10^{-4}$ Pa.

Next, a power source not shown in the figures is connected to the flexible cable connected to the output lines of the X-direction wiring and the Y-direction wiring of the electron source substrate 61, and a second activation is performed by applying a voltage to the X-direction wiring and to the Y-direction wiring. The voltage application is performed by connecting all of the Y-direction wirings to a common ground, and applying a voltage to selected lines of the X-direction wirings. The applied voltage is a bipolar voltage waveform, similar to that of the first activation, and a 16 V voltage is applied for 20 minutes.

The support member 1608 is then lowered, and the electron source base 61 is removed by using a conveyor arm 1604.

The device current If during activation is increased smoothly in Embodiment 3, and the value of the device current If at the time of completion of activation for each device is on the order of 1.6 mA. Further, the activation profiles (the relationship between activation time and device current If) of the first activated line and the last activated line are nearly equal, and therefore all of the electron-emitting devices can be similarly activated. Furthermore, the activation profile is nearly identical after performing activation of five electron source substrates in succession, and therefore activation can be performed with good repeatability.

Comparative Example 2

The first activation process and the second activation process are performed using the same vacuum container as a comparative example.

An electron source substrate is prepared, similar to Embodiment 3, and forming is performed.

The substrate is then set on the support member 1607 of the activation device of FIG. 14, similar to Embodiment 3, and fixed in place.

The support member 1607 is next raised, and the electron source substrate and the vacuum container 1605 are brought into contact. An airtight seal is maintained by an o-ring between the vacuum container 1605 and the substrate.

The valve 1614 is opened next, and after evacuating the inside of the vacuum container 1605 using the evacuation device 1616, the valve 1612 is opened. Tornitrile is introduced into the vacuum container from the activation substance holding chamber 1610. The valve 1612 opening is regulated so that the partial pressure of tornitrile inside the vacuum container becomes $1\times10^{-3}$ Pa.

A voltage is then applied, similar to Embodiment 3, and a first activation is performed.

The valve 1612 is then closed, and after evacuating the inside of the vacuum container 1605 until the pressure becomes $5\times10^{-6}$ Pa or less, the valve 1612 is once again opened, and tornitrile is introduced into the vacuum container 1605 from the activation substance holding chamber 1610. The valve 1612 opening is regulated so that the partial pressure of tornitrile inside the vacuum container becomes $1\times10^{-4}$ Pa.

A voltage is then applied, similar to Embodiment 3, and after performing the second activation, the substrate is removed.

The device current If during activation is increased smoothly in comparative example 2. However, when compared to the activation profile of the second activation process, the rate of increase of the device current If (amount of increase in If/time) five minutes after activation causes the lines activated in the initial stage to be slightly larger than the lines activated later, and a condition is seen in which the lines activated in the initial stage of the second activation process are affected by organic matter remaining from the first activation process.

Embodiment 4

Embodiment 4 is an example of an image-forming apparatus in which an electron source manufactured in accordance with the present invention is applied. The electron source substrate 61 manufactured in accordance with Embodiment 3 is used, and the image forming device shown in FIG. 7 is manufactured, similar to Embodiment 2.

Electrons are emitted by applying a voltage of 14 V to each electron-emission device in the image-forming device thus completed, through external terminals Dox1 through Doxm, and Doy1 through Doyn. Further, a 1 kV high voltage is applied to the metal back 75 through the high voltage terminal 77. If the electron emission ratio Ie/If is measured at this point, where If is the device current flowing in the electron emission device, and Ie is the emission current emitted from the electron-emission device and arriving at the metal back 75, then the electron emission ratio is approximately 0.15%, having good electron emission characteristics.

A 6 kV high voltage is next applied to the metal back 75 through the high voltage terminal 77, and the emitted electrons are collided with the fluorescent film 74, and an image is displayed by excitation and emission of light. The image display device of Embodiment 4 has no noticeable dispersion in luminescence or uneven colors, and can display a good image which sufficiently satisfies its use as a television.

Embodiment 5

Embodiment 5 is an example of another method of manufacturing an electron source.

An electron source substrate is formed in accordance with steps (a) to (d) of Embodiment 1. Flexible cables are mounted on the output lines of the X-direction wiring and the Y-direction wiring of the formed electron source substrate. Forming is then performed, similar to step (e) of Embodiment 1, forming an electron-emitting region.

Next, activation of the electron source substrate 61 on which forming has been completed is performed using the activation device shown in FIG. 14.

The electron source substrate 61 is first set on the conveyor arm 1602 used for entry, and the electron source substrate 61 is then placed and fixed on the support member 1607 by using the conveyor arm 1602.

The support member 1607 is then raised, and the electron source substrate 61 and the first vacuum container 1605 are brought into contact. An airtight seal is maintained by an o-ring between the first vacuum container 1605 and the substrate 61.

The valve 1614 is opened next, and after evacuating the inside of the first vacuum container 1605 by the evacuation device 1616, the valve 1612 is opened. An ethylene and nitrogen gas mixture (ethylene to nitrogen ratio is 1:100) is introduced into the first vacuum container from the activation substance holding chamber 1610, and the valve 1612 opening is regulated so that the pressure inside the first vacuum container becomes $2\times10^{2}$ Pa.

Next, a power source not shown in the figures is connected to the flexible cable connected to the output lines of the X-direction wiring and the Y-direction wiring of the electron source substrate 61, and a first activation is performed by applying a voltage to the X-direction wiring and to the Y-direction wiring. The voltage application is performed by connecting all of the Y-direction wirings to a common ground, and applying a voltage to selected lines of the X-direction wirings. The applied voltage is a bipolar voltage waveform, similar to that of Embodiment 1, and the wave height of the applied voltage is increased from 10 V to 16 V at a rate of 0.1 V/sec for 1 minute, after which 16 V is applied for another 1 minute.

The support member 1607 is then lowered, and the electron source substrate 61 is moved to the support member 1608 by using the conveyor arm 1603, and fixed in place.

The support member 1608 is then raised, and the electron source substrate 61 and the second vacuum container 1606 are brought into contact. An airtight seal is maintained by an o-ring between the second vacuum container 1606 and the substrate 61.

The valve 1615 is opened next, and after evacuating the inside of the second vacuum container 1606 by the evacuation device 1617, the valve 1613 is opened. Benzonitrile is introduced into the second vacuum container from an activation substance holding chamber 1611, and the valve 1613 opening is regulated so that the partial pressure of benzonitrile inside the second vacuum container becomes $1\times10^{-4}$ Pa.

Next, a power source not shown in the figures is connected to the flexible cable connected to the output lines of the X-direction wiring and the Y-direction wiring of the electron source substrate 61, and a second activation is performed by applying a voltage to the X-direction wiring and to the Y-direction wiring. The voltage application is performed by connecting all of the Y-direction wirings to a common ground, and applying a voltage to selected lines of the X-direction wirings. The applied voltage is a bipolar voltage waveform, similar to that of the first activation, and a 16 V applied voltage is applied for 20 minutes.

The support member 1608 is then lowered, and the electron source substrate 61 is removed by using the conveyor arm 1604.

The device current If during activation is increased smoothly in Embodiment 5, and the value of the device current If at the time of completion of the activation for each device is on the order of 1.7 mA. Further, the activation profiles (the relationship between activation time and device current If) of the first activated line and the last activated line are nearly equal, and therefore all of the electron-emitting devices can be similarly activated. Furthermore, the activation profile is nearly identical after performing activation of five electron source substrates in succession, and therefore activation can be performed with good repeatability.

Embodiment 6

Embodiment 6 is an example of an image-forming apparatus in which an electron source manufactured in accordance with the present invention is applied.

The electron source substrate 61 manufactured in accordance with Embodiment 5 is used, and the image forming device shown in FIG. 7 is manufactured, similar to Embodiment 2.

Electrons are emitted by applying a voltage of 14 V to each electron-emission device in the image-forming device thus completed, through external terminals Dox1 through Doxm, and Doy1 through Doyn. Further, a 1 kV high voltage is applied to the metal back 75 through the high voltage terminal 77. If the electron emission ratio Ie/If is measured at this point, where If is the device current flowing in the electron emission device, and Ie is the emission current emitted from the electron-emission device and arriving at the metal back 75, then the electron emission ratio is approximately 0.15%, having good electron emission characteristics.

A 6 kV high voltage is next applied to the metal back 75 through the high voltage terminal 77, and the emitted electrons are collided with the fluorescent film 74, and an image is displayed by excitation and emission of light. The image display device of Embodiment 6 has no noticeable dispersion in luminescence or uneven colors, and can display a good image which sufficiently satisfies its use as a television.

Embodiment 7

Embodiment 7 is an example of the manufacture of an electron source in which a multiple number of FE type electron-emission devices are arranged in a simple matrix. First, an electron source substrate as shown in FIG. 12 is manufactured as below. The number of devices in the X-direction is 900, with 300 devices in the Y-direction.

Step (a)

A cathode electrode 102 from copper, a resistive layer 110 from amorphous silicon, an insulating layer 104 formed by thermal oxidation of silicon, and a gate electrode 105 from molybdenum are laminated on a glass substrate 101. Photoresist is then applied to the molybdenum film, and a pattern corresponding to an aperture of the gate electrode is formed. Hydrofluoric acid is then applied to the aperture of the insulating layer 104, after which the photoresist is removed.

Step (b)

Aluminum is then obliquely evaporated while rotating the substrate inside a vacuum evaporation device, forming a mask layer 106.

Step (c)

Molybdenum is next evaporated in a vertical direction with respect to the substrate, forming a conic shape emitter 103.

Step (d)

The mask layer 106 from aluminum formed on the gate electrode and the molybdenum layer are next removed, forming an electron source substrate 100 provided with a multiple number of FE type electron-emission devices. Further, output lines are formed in the peripheral area of the electron-emission devices.

Step (e)

Next, activation of the formed electron source substrate 100 is performed using the activation device shown in FIG. 10.

First, the electron source substrate 100 is set on the conveyor arm 1210 of the entry room 1201 of the activation device. After evacuating the inside of the entry room 1201 for several minutes with the evacuation device 1221, the gate valve 1206 is opened. The electron source substrate 100 is conveyed to the inside of the first vacuum container 1202 by using the conveyer arm 1210, and is set on the support member 1213. The conveyor arm 1210 is returned to the entry room 1201, and the gate valve 1206 is closed.

With the first vacuum container 1202 in an evacuated state by using the evacuation device 1222, the valve 1226 and the valve 1227 are opened, and tornitrile is introduced into the first vacuum container from the activation substance holding chamber 1219. The valve 1227 opening is regulated so that the partial pressure of tornitrile inside the first vacuum container becomes $1\times10^{-2}$ Pa.

The voltage application probe 1215 is then contacted with the output lines of the electron source substrate 100, and a voltage of 100 V is applied from the power source 1217, through the output lines, between the cathode electrode 102 and the gate electrode 105. The voltage waveform is the waveform shown in FIG. 5, T1 is set to 1 msec, T2 to 20 msec, and the application time is 5 minutes. Further, a voltage of 5 kV is applied to an anode electrode (not shown in the figures) set 3 mm above the substrate. Thus the first activation is performed.

Step (f)

Next, after evacuating the inside of the conveyor room 1204 for several minutes by using the evacuation device 1223, the gate valve 1207 is opened, and the electron source substrate 100 is moved inside the conveyor room 1204 using the conveyer arm 1211.

The gate valve 1207 is closed, and after evacuating the inside of the conveyor room 1204 for several minutes by using the evacuation device 1223, the gate valve 1208 is opened. The electron source substrate 100 is then conveyed to the inside of the second vacuum container 1203 by using the conveyor arm 1211, and set on the support member 1214. The conveyor arm 1211 is returned to the conveyor room 1204, and the gate valve 1208 is closed.

With the second vacuum container 1203 in an evacuated state by using the evacuation device 1224, the valve 1228 and the valve 1229 are opened, and tornitrile is introduced into the second vacuum container from the activation substance holding chamber 1220. The valve 1229 opening is regulated so that the partial pressure of tornitrile inside the second vacuum container becomes $1\times10^{-4}$ Pa.

The voltage application probe 1216 is then contacted with the X-direction wiring and with the Y-direction wiring of the electron source substrate 100, and a voltage of 120 V is applied between the cathode electrode 102 and the gate electrode 105 by the power source 1218. The voltage waveform is the waveform shown in FIG. 5, T1 is set to 1 msec, T2 to 20 msec, and the application time is 15 minutes. Further, a voltage of 5 kV is applied to the anode electrode (not shown in the figures) set 3 mm above the substrate. Thus the second activation is performed.

Next, after evacuating the inside of the exit room 1205 for several minutes by using the evacuation device 1225, the gate valve 1209 is opened, and the electron source substrate 100 is moved inside the exit room 1205 using the conveyer arm 1212.

The gate valve 1209 is closed, and after purging the inside of the exit room 1205 to atmospheric pressure, the electron substrate 100 is removed.

The emission current emitted from the emitter during activation, and captured by the anode electrode, increases smoothly in Embodiment 7. Further, the activation profiles (the relationship between activation time and emission current) of the first activated line and the last activated line are nearly equal, and therefore all of the electron-emitting devices can be similarly activated.

Embodiment 8

Embodiment 8 is an example of an image forming device in which an electron source manufactured in accordance with the present invention is applied.

The image forming device is manufactured by using the electron source substrate 100 manufactured similarly to Embodiment 7, which is bonded to a face plate through a support frame, similar to Embodiment 2.

Electrons are emitted from the emitter by applying a voltage of 120 V on each electron-emitting device between the cathode electrode and the gate electrode in the image-forming device completed as above, through external terminals. Further, a high voltage of 6 kV is applied to the metal back 75 through the high voltage terminal 77, and the emitted electrons are collided with the fluorescent film 74, and an image is displayed by excitation and emission of light. The image display device of Embodiment 8 has no noticeable fluctuation in luminescence or uneven colors, and can display a good image that sufficiently satisfies its use as a television.

As stated above, according to the electron-emission device and the electron source manufacturing method of the present invention, by performing the activation process in several stages using a multiple number of chambers with differing atmospheres, an electron-emission device and an electron source having good electron-emission characteristics can be provided by a shortened time activation process.

Further, according to the electron-emission device and the electron source manufacturing method of the present invention, by performing the activation process in several stages using a multiple number of chambers with differing atmospheres, the activation substance insufficient supply problem of a conventional activation process can be solved, and it is possible to manufacture an electron-emission device and an electron source having good characteristics.

Furthermore, activation can be performed with good repeatability because the influence of matter remaining inside the chamber can be avoided. Therefore, dispersion in manufacturing can be reduced, and the yield can be increased.

Further, according to the manufacturing device of the electron source in the present invention, inside each of the multiple number of chambers is provided with means for evacuation and means for introducing a gas inside the chamber, and therefore it is possible to independently set and control the internal atmosphere of each chamber. Moreover, the manufacturing device is also provided with means for entering and means for exiting the respective chambers for the substrate forming the electron source, and therefore the substrate can be taken to each of the controlled atmospheres in order with good efficiency, and productivity can be made more efficient.

In addition, according to an image-forming device in which an electron source manufactured in accordance with the method of manufacture of the present invention, a high definition image-forming device with, for example a flat color television, can be provided.

What is claimed is:

1. A method of manufacturing an electron-emitting device, comprising a process for forming a pair of electric conductors spaced from each other on a substrate, and an activation process for forming a film of carbon or a carbon compound on at least one of said pair of electric conductors, wherein said activation process is sequentially performed within plural containers having different atmospheres.

2. A method of manufacturing an electron-emitting device, comprising a process for forming an electroconductive film on a substrate, including an electron-emitting region arranged between a pair of electrodes, and an activation process for forming a film of carbon or a carbon compound on said electroconductive film, wherein said activation process is sequentially performed within plural containers having different atmospheres.

3. A method of manufacturing an electron source, comprising a process for forming plural pairs of electric conductors each spaced from each other on a substrate, and an activation process for forming a film of carbon or a carbon compound on at least one of each said pairs of electric conductors, wherein said activation process is sequentially performed within plural containers having different atmospheres.

4. A method of manufacturing an electron source according to claim 3, wherein said plural containers include plural containers in which kinds of gases contained in the atmospheres are different from each other, and at least two of said containers include the carbon compound in the atmospheres.

5. A method of manufacturing an electron source according to claim 3, wherein said plural containers include plural containers in which carbon compounds contained in the atmospheres are different from each other.

6. A method of manufacturing an electron source according to claim 3, wherein said plural containers include plural containers in which partial pressures of the carbon compound contained in the atmospheres are different from each other.

7. A method of manufacturing an electron source according to claim 3, wherein said activation process includes a process for applying a voltage between said pair of electric conductors in an atmosphere containing the carbon compound.

8. A method of manufacturing an image-forming apparatus having an electron source and an image-forming member for forming an image by irradiating electrons from said electron source, wherein said electron source is manufactured by the method according to any one of claims 3 to 7.

9. A method of manufacturing an electron source, comprising a process for forming plural electroconductive films on a substrate, including an electron-emitting region arranged between a pair of electrodes, and an activation process for forming a film of carbon or a carbon compound on each of said electroconductive films, wherein said activation process is sequentially performed within plural containers having different atmospheres.

10. A method of manufacturing an electron source according to claim 9, wherein said plural containers include plural containers in which kinds of gases contained in the atmospheres are different from each other, and at least two of said containers include the carbon compound in the atmospheres.

11. A method of manufacturing an electron source according to claim 9, wherein said plural containers include plural containers in which carbon compounds contained in the atmospheres are different from each other.

12. A method of manufacturing an electron source according to claim 9, wherein said plural containers include plural containers in which partial pressures of the carbon compound contained in the atmospheres are different from each other.

13. A method of manufacturing an electron source according to claim 9, wherein said activation process includes a process for applying a voltage between said pair of electrodes in an atmosphere containing the carbon compound.

14. A method of manufacturing an image-forming apparatus having an electron source and an image-forming member for forming an image by irradiating electrons from said electron source, wherein said electron source is manufactured by the method according to any one of claims 9 to 13.

* * * * *

UNITED STATES PATENT AND TRADEMARK OFFICE

CERTIFICATE OF CORRECTION

PATENT NO. : 6,419,539 B1
DATED : July 16, 2002
INVENTOR(S) : Miki Tamura et al.

It is certified that error appears in the above-identified patent and that said Letters Patent is hereby corrected as shown below:

Column 14,
Line 33, ".1217" should read -- 1217 --.

Signed and Sealed this

Eleventh Day of March, 2003

JAMES E. ROGAN
*Director of the United States Patent and Trademark Office*